US011273353B2

(12) United States Patent
Speed et al.

(10) Patent No.: US 11,273,353 B2
(45) Date of Patent: Mar. 15, 2022

(54) SYSTEMS AND METHODS FOR CLIMBING

(71) Applicant: Fast Twitch Industries, LLC, Lehi, UT (US)

(72) Inventors: Boone Speed, Salt Lake City, UT (US); Kevin Bradburn, Salt Lake City, UT (US); Cameron Hellewell, Bountiful, UT (US)

(73) Assignee: Fast Twitch Industries, LLC, Lehi, UT (US)

( * ) Notice: Subject to any disclaimer, the term of this patent is extended or adjusted under 35 U.S.C. 154(b) by 0 days.

(21) Appl. No.: 16/518,751

(22) Filed: Jul. 22, 2019

(65) Prior Publication Data

US 2020/0023257 A1 Jan. 23, 2020

Related U.S. Application Data

(60) Provisional application No. 62/701,922, filed on Jul. 23, 2018.

(51) Int. Cl.

| | |
|---|---|
| ***A63B 24/00*** | (2006.01) |
| ***A63B 71/06*** | (2006.01) |
| ***A63B 69/00*** | (2006.01) |

(52) U.S. Cl.

CPC ..... *A63B 69/0048* (2013.01); *A63B 24/0062* (2013.01); *A63B 24/0075* (2013.01);

(Continued)

(58) Field of Classification Search

CPC ..... A63B 69/0048; A63B 24/0062; A63B 24/0075; A63B 71/0622;

(Continued)

(56) References Cited

U.S. PATENT DOCUMENTS

| | | | | |
|---|---|---|---|---|
| 4,848,737 | A | 7/1989 | Ehrenfield | |
| 5,125,877 | A * | 6/1992 | Brewer | A63B 69/0048 482/37 |

(Continued)

FOREIGN PATENT DOCUMENTS

| | | |
|---|---|---|
| CA | 3107437 A1 | 1/2020 |
| CN | 112930218 | 6/2021 |

(Continued)

OTHER PUBLICATIONS

Swierzynski, "Fitness Training Over Skype" [online] (retrieved from the Internet on Oct. 12, 2019) <URL: https://blogs.skype.com/stories/2017/02/21/fitness-training-over-skype/>, Feb. 21, 2017 (Feb. 21, 2017).

*Primary Examiner* — Sundhara M Ganesan
*Assistant Examiner* — Shila Jalalzadeh Abyaneh
(74) *Attorney, Agent, or Firm* — David B. Tingey; Bryant J. Keller; Kirton McConkie

(57) ABSTRACT

Systems and methods for providing climbing walls are discussed. While such systems and methods can include any suitable component, in some cases, they include a climbing wall that has a base member and a climbing surface that includes at least one climbing hold. In some cases, the climbing surface is pivotally connected to the base member. Additionally, in some cases, the system includes an anchor that is configured to adjustably retain the climbing surface at an angle with respect to the base member. In some cases, the system further includes a camera, microphone, and/or display that are configured to allow a climber to have audio and/or visual interactions with another person in a remote location (e.g., for training, competition, etc.). In some cases, at least one climbing hold on the climbing surface comprises a sensor that is configured to indicate when a climber has used that hold. Other implementations are described.

23 Claims, 21 Drawing Sheets

(52) U.S. Cl.
CPC .... *A63B 71/0622* (2013.01); *A63B 2071/063* (2013.01); *A63B 2071/0647* (2013.01); *A63B 2220/56* (2013.01); *A63B 2220/806* (2013.01); *A63B 2225/20* (2013.01)

(58) Field of Classification Search
CPC ..... A63B 2071/0647; A63B 2220/806; A63B 2225/20; A63B 2071/063; A63B 2220/56; A63B 2220/80; A63B 2220/833; A63B 2071/0625; A63B 2220/808; A63B 24/0003; A63B 2225/093; A63B 2225/09; A63B 2209/00; A63B 2024/0025; A63B 71/023; A63B 2071/0655; A63B 2225/50; A63B 2225/74; A63B 1/00; A63B 22/0017; A63B 22/0023
See application file for complete search history.

(56) References Cited

U.S. PATENT DOCUMENTS 5,549,195 A * 8/1996 Aulagner ..... A63B 69/0048 198/850
6,083,142 A * 7/2000 Wilson ..... A63B 69/0048 280/DIG. 8
6,231,482 B1 * 5/2001 Thompson ..... A63B 22/02 482/37
6,551,215 B1 * 4/2003 Gordon ..... A63B 69/0048 472/134
6,860,836 B1 * 3/2005 Wu ..... A63B 22/001 198/850
6,872,167 B1 * 3/2005 Meissner ..... B63B 34/00 482/37
7,195,582 B2 * 3/2007 Wu ..... A63B 22/001 198/850
7,731,632 B2 * 6/2010 Wu ..... A63B 69/0048 482/37
8,668,626 B1 * 3/2014 Horowitz ..... A63B 24/0075 482/37
8,808,145 B1 8/2014 Parsons et al.
8,951,166 B2 2/2015 Bae
9,132,330 B2 * 9/2015 Brendle ..... A63B 21/169
9,600,716 B2 * 3/2017 Skjaerseth ..... G06K 9/00342
9,770,614 B1 * 9/2017 Sudeith ..... A63B 69/0048
2002/0169052 A1 * 11/2002 Godsey ..... A63B 69/0048 482/37
2003/0060333 A1 * 3/2003 Sudeith ..... A63B 69/0048 482/37
2003/0228956 A1 * 12/2003 Paci ..... A63B 69/0048 482/37
2004/0229732 A1 * 11/2004 Wang ..... A63B 69/0048 482/37
2006/0199627 A1 * 9/2006 Oliver ..... E02D 27/02 463/2
2008/0293547 A1 * 11/2008 Moy ..... A63B 69/0048 482/36
2008/0300111 A1 * 12/2008 Meissner ..... A63B 69/0048 482/36
2010/0004098 A1 1/2010 Hensley
2015/0057776 A1 * 2/2015 Skjaerseth ..... A63B 24/0075 700/91
2017/0266533 A1 * 9/2017 Dalebout ..... A63B 71/0622
2019/0009157 A1 * 1/2019 Sudeith ..... A63B 71/0054

FOREIGN PATENT DOCUMENTS

DE 102005063225 * 6/2007 ..... A63B 69/0048
DE 102005063225 A1 * 6/2007 ..... A63B 69/0048
DE 102006010413 B3 * 10/2007 ..... A63B 69/0048
DE 202007014591 * 4/2008 ..... A63B 69/00
DE 102007041061 A1 * 3/2009 ..... A63B 71/0036
EP 3826734 6/2021
ES 2208074 * 6/2004 ..... A63B 69/0048
ES 2208074 A1 * 6/2004 ..... A63B 69/0048
FR 2682606 * 4/1993 ..... A63B 69/0048
FR 2682606 A1 * 4/1993 ..... A63B 69/0048
FR 2692488 A1 * 12/1993 ..... A63B 69/0048
FR 2977501 A1 * 1/2013 ..... A63B 69/0048
JP 11347170 A * 12/1999
KR 2016132564 * 11/2016
WO WO-8909635 * 10/1989 ..... A63B 21/4035
WO WO-8909635 A2 * 10/1989 ..... A63B 21/4035
WO WO-9108806 A1 * 6/1991 ..... A63B 69/0048
WO WO-2012158245 A1 * 11/2012 ..... G01S 5/14
WO 2016049786 A1 4/2016
WO WO-2016049786 A1 * 4/2016 ..... A63B 23/0233
WO 2020/023453 A1 1/2020

* cited by examiner

FIG. 8
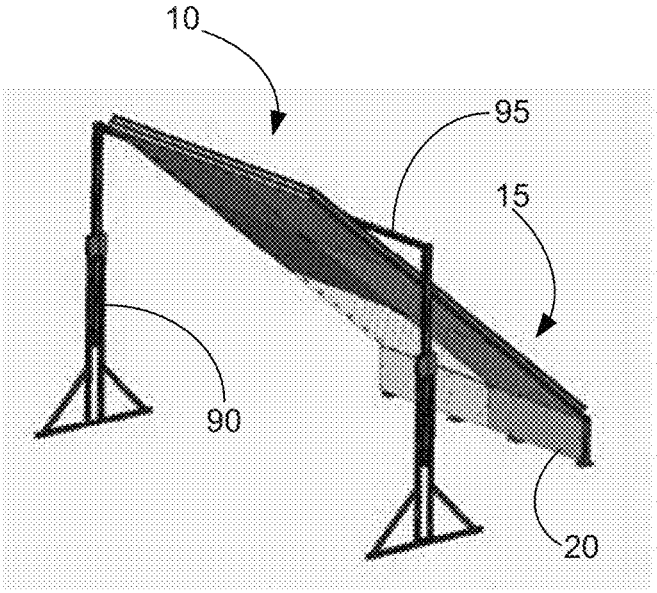
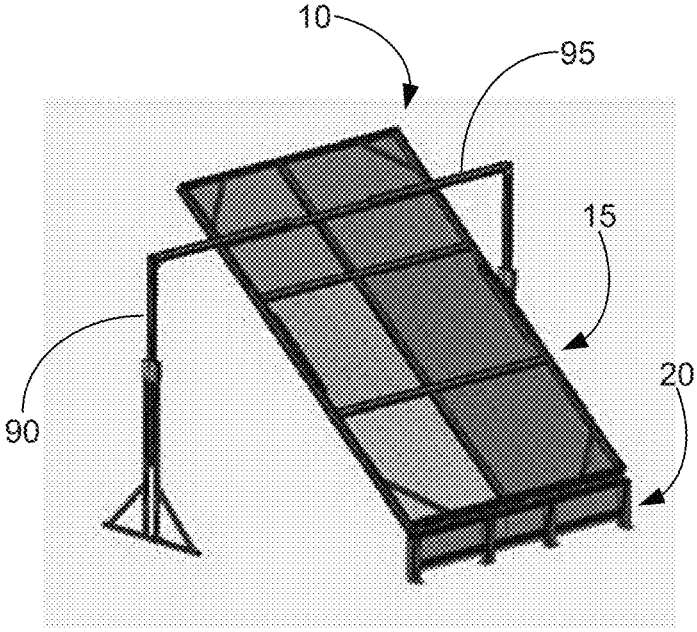
FIG. 9

SYSTEMS AND METHODS FOR CLIMBING

CROSS-REFERENCE TO RELATED APPLICATION

This application claims priority to U.S. Provisional Application No. 62/701,922, which was filed on Jul. 23, 2018, and which is entitled SYSTEMS AND METHODS FOR CLIMBING; the entire disclosure of which is hereby incorporated herein.

BACKGROUND OF THE INVENTION

Field of the Invention

The present invention relates to systems and methods for climbing. More particularly, some implementations of the described invention relate to systems and methods for providing an adjustable climbing wall having a climbing surface that is readily adjustable to a plurality of angles or positions.

Background and Related Art

Rock climbing is becoming an ever more popular sport. In this regard, rock climbing often involves climbing up, down, and/or across natural rock formations. Rock climbing can be accomplished through a variety of climbing techniques, including, but not limited to, aid climbing (in which a climber repeatedly places and weights gear that is used to provide safety and to aid ascent), free climbing (in which a climber uses anchors, ropes, and/or other forms of protection as passive ascending aids), bouldering (in which a climber climbs relatively short routes without the use of a safety rope), solo climbing (in which a climber climbs alone, without a belay, deep-water solo climbing (in which a climber climbs over relatively deep water instead of the ground), free solo climbing (in which a climber climbs alone without the use of a rope or other safety equipment), roped solo climbing (in which a rope is secured at the beginning of a climb to allow a climber to self-belay as the climber advances), lead climbing (in which a lead climber ascends and passes a rope through a number of anchors that are below the lead climber), multi-pitch climbing (in which a climber breaks a route into multiple segments or pitches), and a variety of other climbing techniques. Whatever the technique, however, the goal in rock climbing is typically the same—to climb to the end of a climbing route (often the summit) without falling.

In an effort to: practice climbing, learn new climbing techniques, exercise, save travel time, and/or climb in a relatively safe environment, many people do at least some of their climbing on artificial rock surface (or other climbing) surfaces. While such artificial rock surfaces have been found to be useful, they are not necessarily without their shortcomings. Indeed, some artificial rock surfaces can be often relatively difficult and time consuming to build. Additionally, some artificial climbing surfaces are quite heavy—making them difficult for most people to transport and/or assemble. Moreover, for a variety of reasons, some artificial rock surfaces can take relatively long periods of time to assemble. Additionally, the climbing routes on some artificial rock surfaces are relatively static. As a result, a climber can often become bored with such surfaces relatively quickly. Similarly, as a climber improves, some such artificial rock surfaces are not easily modifiable to continuously stretch the climber and to improve the climber's climbing ability.

Thus, while systems and methods currently exist that are used to provide climbers with an artificial rock surface for climbing, some challenges still exist, including those listed above. Accordingly, it would be an improvement in the art to augment or even replace current techniques with other techniques.

SUMMARY OF THE INVENTION

The present invention relates to systems and methods for climbing. More particularly, some implementations of the described invention relate to systems and methods for providing an adjustable climbing wall having a climbing surface that is readily adjustable to a plurality of angles or positions.

While the described climbing walls can include any suitable component, in some cases, the described climbing walls have a base member and a climbing panel (and/or climbing surface) that includes at least one climbing hold. In some cases, the climbing panel is pivotally connected to the base member, such that the climbing panel can be selectively moved to and from a variety of positions (or angles) with respect to the base member. Additionally, in some cases, the system includes one or more supports that are configured to selectively and adjustably retain the climbing panel at one or more angles with respect to the base member. In some cases, the supports are configured to manually and/or automatically adjust the angle of the climbing wall with respect to the base (e.g., between climbs, during a climb, and/or at any other suitable time).

In some cases, the supports comprise one or more cables, chains, come-alongs, hoists, ratcheting straps, linear actuators, cable actuators, threaded rod actuators, actuators, servos, winches, cable ratchet winches, straps, boards, arms, solid supports, bars, load bars, angle irons, legs, struts, and/or other suitable supports. In some implementations, however, the supports comprise one or more legs that are configured to hold the climbing panel at a desired angle. While such legs can be disposed in any suitable location, in some implementations, at least one leg is disposed at each of two sides of the climbing panel.

In some cases, the system further includes one or more cameras, microphones, speakers, and/or displays that are configured to allow a climber (which term may refer to any user) to have audio and/or visual interactions with another person in a remote location (e.g., for training, competition, companionship, etc.).

In some implementations, at least one climbing hold on the climbing panel comprises a sensor that is configured to indicate when a climber has used that hold. Accordingly, in some cases, the described systems can track a climber's movements on the climbing panel; adjust proposed climbing routes based on the climber's location, past climbs, another climber's activities, and/or any other suitable factor; notify others (e.g., a climber on another climbing wall) of the routes and/or location of the climber; track the amount of weight placed on particular holds; track the time spent on a particular hold; and/or for any other suitable purpose.

In some cases, the described climbing walls are configured to provide moisture to at least one of the climbing panel, a climbing hold, the base member, and/or the climber. As a result, some implementations of the climbing wall can simulate dew, moisture, rain, springs, and/or other moist circumstances that a climber may find in nature.

In some implementations, the described climbing walls comprise one or more projectors and/or other displays that are configured to give the climbing wall the appearance of a natural and/or fabricated climbing surface.

In some cases, the described climbing wall comprises one or more light sources that are configured to light up one or more holds and/or climbing courses, to indicate which hold should be used next, to indicate which holds have been used, to track a climber's path, to indicate the holds that another climber is using (e.g., in real time) or has used, to indicate which holds are part of a particular path, to indicate the difficulty of a particular hold and/or climbing path, and/or for any other suitable purpose. In some such cases, one or more lights are coupled to the climbing surface (e.g., climbing panel) and/or to the base member so as to be disposed near one or more climbing holds (or holds). Additionally, in some cases, one or more of the holds themselves comprise one or more such light sources (e.g., LEDs, incandescent lights, and/or any other suitable lights sources).

Where a hold comprises a light source (e.g., LED), the light source can be disposed in any suitable portion of the hold, including, without limitation, in a center of the hold, being substantially centered in a face of the hold, being offset from a center of the hold, being in a hole that is typically used to bolt the hold to a climbing surface, being at a perimeter of the hold, and/or in any other suitable location. In some cases, however, the light source is disposed in a central hole of the hold (e.g., in a hole that is typically formed in the hold to receive a bolt (and/or any other suitable fastener) to secure the hold to a surface (e.g., the climbing panel).

In some cases in which one or more holds comprise one or more light sources, the holds optionally comprise a lens to cover, protect, diffuse light from, and/or otherwise cover the light source. In some such cases, the lens is recessed within the hold. In some other cases, however, a portion of the lens and/or the light source is configured to extend from a portion of hold (e.g., such that light from the light source is easily visible on the hold, even if the climber is above, below, and/or at any other suitable location with respect to the hold).

Although the holds can couple to the climbing wall in any suitable manner, including, without limitation, by having one or more bolts and/or other suitable fasteners extend through an opening in the hold and be coupled with a treaded coupler of (e.g., a T-nut, a nut, and/or any other suitable threaded coupler of) and/or directly into the climbing wall, in some cases, one or more threaded couplers (e.g., screws and/or any other suitable threaded couplers) extend through a portion of the climbing wall and are threadedly anchored within the hold. Indeed, in some cases, to prevent the hold from twisting on the climbing wall (and/or any other object to which the hold is coupled), two or more set screws, wood screws, grabber screws, nails, and/or any other suitable fasters extend through a portion of the climbing wall (and/or another suitable object), through a back side of the hold (e.g., a portion of the hold that interfaces with the climbing wall and/or other object), and into a portion of the hold.

While the methods and processes of the present invention may be particularly useful for providing a climbing wall with a single climbing surface, those skilled in the art will appreciate that the described systems and methods can be used in a variety of different applications and in a variety of different areas of manufacture. For instance, the described systems and methods can be used to provide: a climbing wall having multiple climbing surfaces that are independently adjustable, a climbing surface comprising multiple independently adjustable panels within the climbing surface, a climbing surface that includes one or more volumes, a treadmill climbing wall, and/or a foldable origami-style that allows a fluid manipulation of the angles features of a wall. Manipulation for this style can include continuous or non-continuous hinge points of metal of all types, nylon, polypropylene, dynema, Kevlar, polymers, woven fabrics, and/or in any other suitable climbing surface.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above-recited and other features and advantages of the present invention are obtained, a more particular description of the described inventions will be rendered by reference to specific embodiments thereof, which are illustrated in the appended drawings. Understanding that the drawings are not necessarily drawn to scale or in proper proportion, and that the drawings depict only typical embodiments of the present inventions and are not, therefore, to be considered as limiting the scope of the inventions, the present inventions will be described and explained with additional specificity and detail through the use of the accompanying drawings in which:

FIG. 8 illustrates a side perspective view of the adjustable climbing wall in which the climbing wall comprises the pair of support legs, in accordance with a representative embodiment;

FIG. 9 illustrates a back perspective view of the adjustable climbing wall in which the climbing wall comprises the pair of support legs, in accordance with a representative embodiment;

FIGS. 13-21A illustrates various views of multiple representative embodiments of the adjustable climbing wall;

DETAILED DESCRIPTION OF THE INVENTION

The present invention relates to systems and methods for climbing. More particularly, some implementations of the described invention relate to systems and methods for providing an adjustable climbing wall having a climbing surface that is readily adjustable to a plurality of angles or positions.

The following disclosure of the present invention is grouped into two subheadings, namely "Systems and Methods for Climbing" and "Representative Operating Environment." The utilization of the subheadings is for convenience of the reader only and is not to be construed as being limiting in any sense.

Systems and Methods for Climbing

Figure 1:
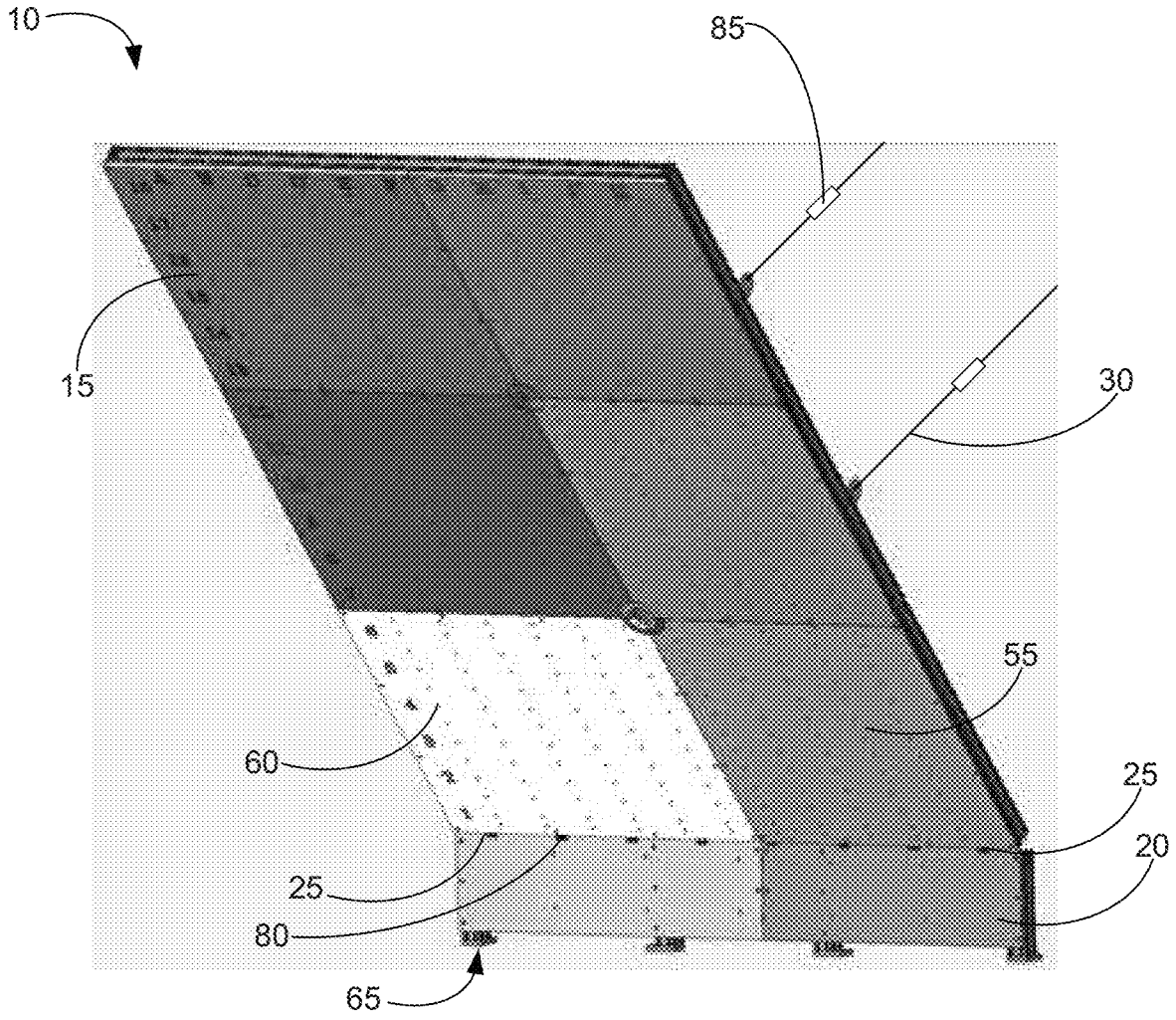
FIG. 1 illustrates a front perspective view of a representative embodiment of an adjustable climbing wall.

As mentioned, the described invention relates to systems and methods for climbing. More particularly, the described systems and methods relate to a climbing wall that has a climbing surface that is selectively adjustable so that an angle of the climbing wall can be varied to any of a plurality of different positions. While the climbing wall can comprise any suitable component that allows it to function in such a manner, FIG. 1 shows a representative embodiment in which the climbing wall 10 comprises one or more climbing surfaces 15, base members 20, pivoting members 25, and/or supports 30.

With respect to the climbing surface 15, the climbing surface can comprise any suitable component that allows a climber to climb on it, and that allows the climbing surface's position to be selectively adjusted. Indeed, in some embodiments, the climbing surface comprises one or more frames and/or climbing panels.

Figure 2:
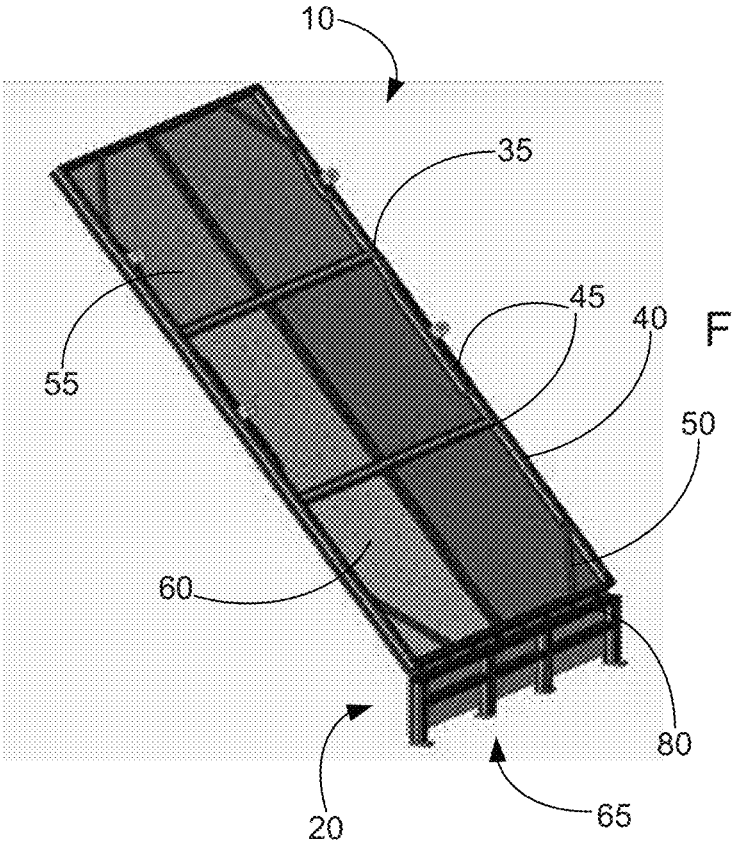
FIG. 2 illustrates a back perspective view of a representative embodiment of the adjustable climbing wall.

With regards to the frame, the frame can comprise any suitable component that allows it to support one or more climbing panels and that allows the frame (and hence the climbing surface 15) to have its position to be selectively adjusted. In some embodiments, the frame comprises one or more frameworks, scaffolds, trusses, structures, supports, ribs, rods, horizontal supports, vertical supports, diagonal supports, struts, crossbars, braces, skeletons, angle irons, pipes, bars, and/or other support structures that are capable of supporting one or more climbing panels. By way of non-limiting illustration, FIG. 2 shows an embodiment in which the frame 35 comprise a framework 40 of crossbars 45 and braces 50 that are configured to be coupled to one or more climbing panels 55. In this regard, the frame is configured to be coupled to the panels in any suitable manner, including, without limitation, via one or more bolts, screws, threaded engagements, rivets, welds, clamps, mechanical engagements, frictional engagements, adhesives, straps, crimps, nails, staples, fasteners, and/or in any other suitable manner. In some embodiments, however, the panels are bolted to the frame.

Turning now to the climbing panels 55, the panels can comprise any characteristic and component that allows a climber to climb up the climbing surface 15. Indeed, in some embodiments, the climbing panels comprise one or more relatively flat surfaces, contoured surfaces, three dimensional volumes, surfaces that are shaped to resemble a natural rock surface, surfaces with built in climbing holds, and/or any other suitably shaped surfaces that include (and/or are capable of including) one or more climbing holds. By way of illustration, FIG. 1 shows an embodiment in which the climbing panels 55 are relatively flat. In some other embodiments, however, the panels comprise one or more raised and/or indented surfaces (e.g., that are configured to resemble a natural climbing surface, a specific climb, an angled surface, and/or any other suitable surface).

Although some embodiments of the climbing panels 55 comprise one or more permanent climbing holds (e.g., holds that are integrally formed with and/or permanently attached to the panels), in some other embodiments, the panels are configured to have one or more holds be coupled to and/or be decoupled from the panels. In such latter embodiments, the holds (e.g., jugs, mini-jugs, slopers, pockets, pinches, crimps, open hand holds, joeys, cobbles, mono holds, jibs, pitted holds, morphology holds, splines, mud holds, sunspots, nibs, wood holds, stone holds, plastic holds, metal holds, ceramic holds, synthetic holds, holds comprising a natural material, and/or any other suitable holds) can selectively couple to and decouple from the panels in any suitable manner. In this regard, the holds can be bolted, clamped, screwed, glued, nailed, fastened, attached via a mechanical engagement, attached via a frictional engagement, and/or otherwise be attached to the panels.

Figure 21A:
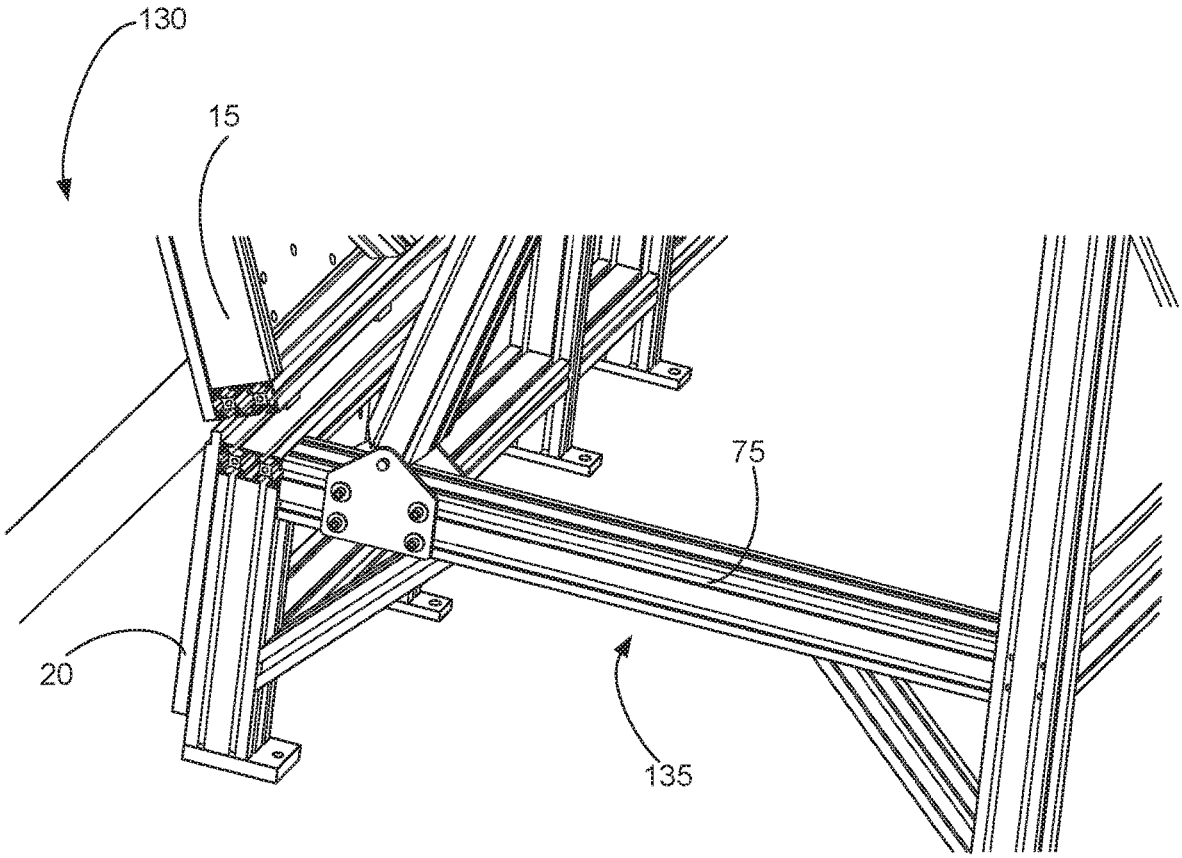
Figure 21B:
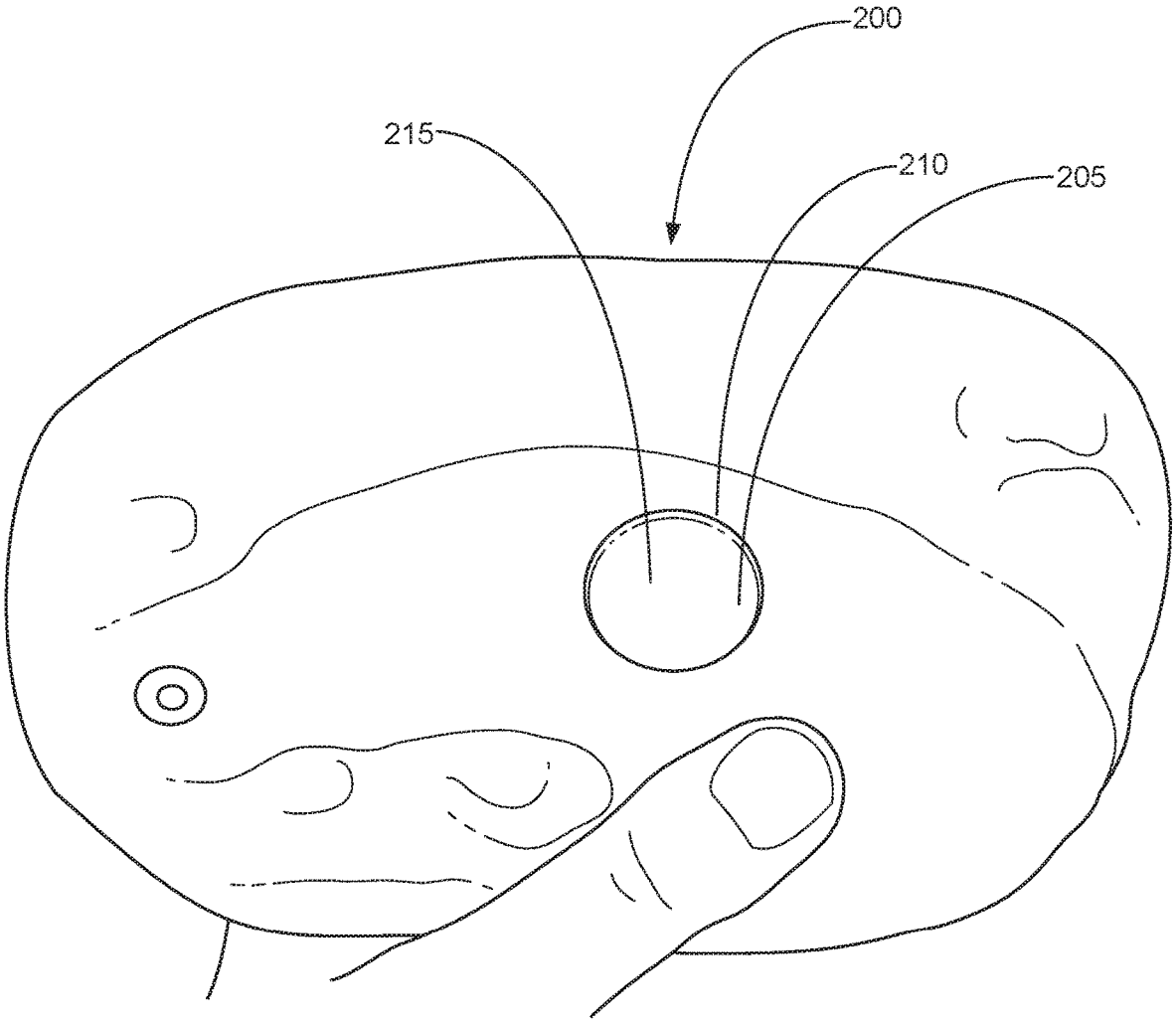
FIGS. 21B-21C each illustrate a view of a climbing hold comprising a light source and a lens in accordance with a representative embodiment.
Figure 21C:
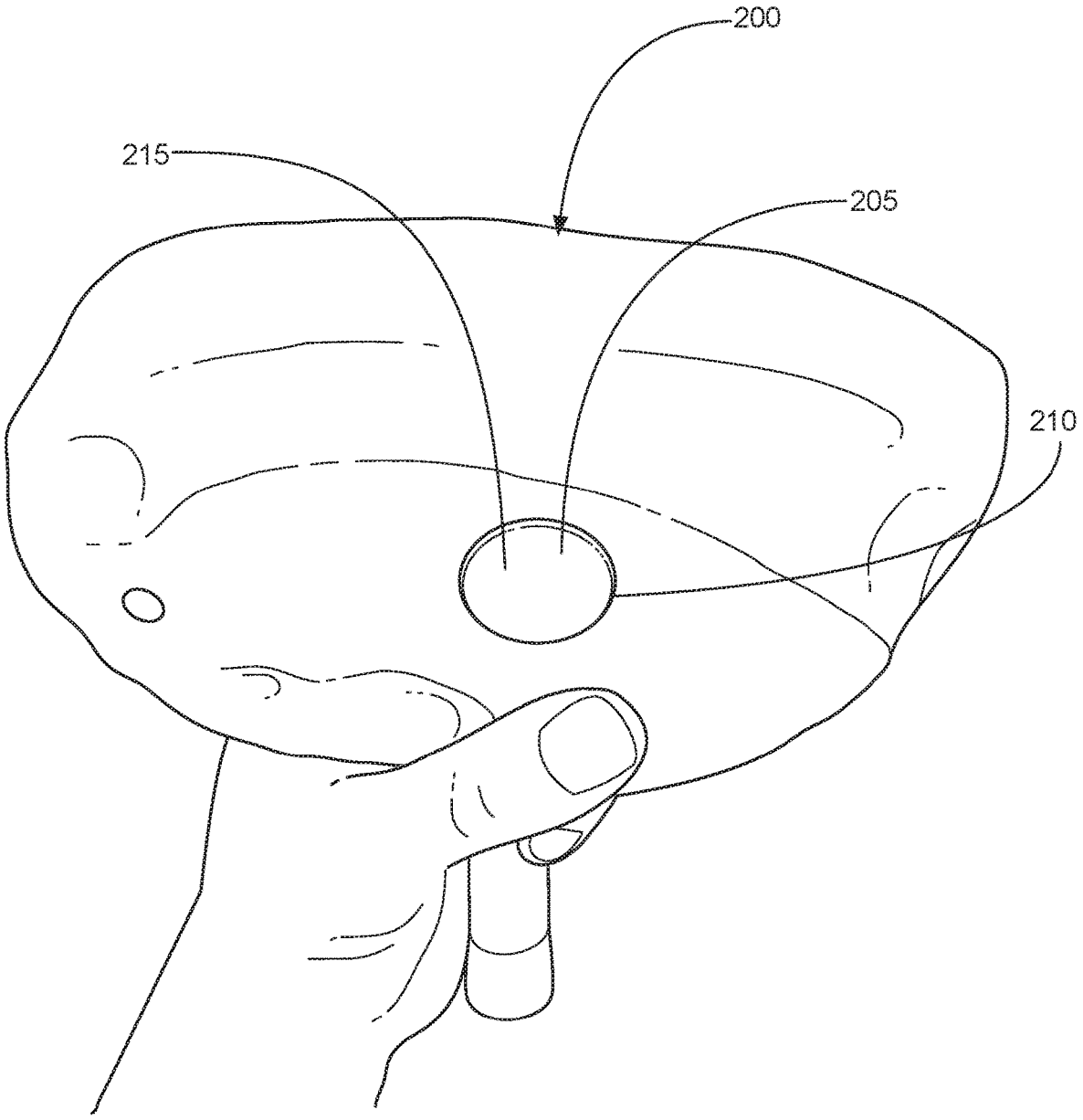
Figure 21D:
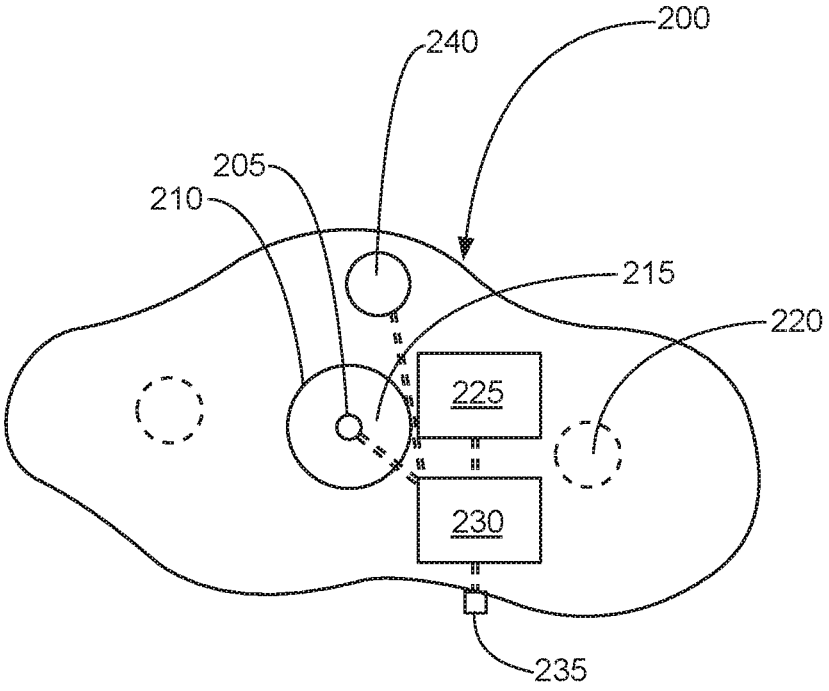
FIG. 21D illustrates a schematic, face view of the climbing hold comprising the light source in accordance with a representative embodiment.
Figure 21E:
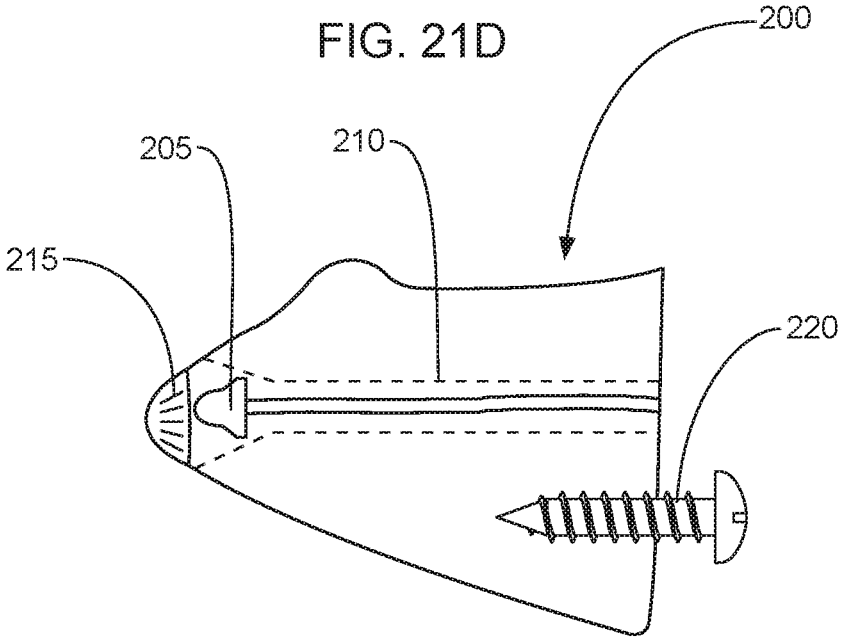
FIG. 21E illustrates a side, schematic view showing the climbing hold comprising the light source in accordance with a representative embodiment.

In some embodiments, the holds are configured to be bolted to the climbing panels 55 (e.g., the panels comprise one or more T-nuts, nuts, and/or bolt receptacles; holes, catches; washers, sleeves, and/or other mechanisms for securing the holds to the panels). By way of non-limiting illustration, FIG. 1 shows an embodiment in which the panels 55 comprise a grid of holes 60 (e.g., holes comprising threaded receptacles, T-nuts, and/or any other suitable type of hold connection points (not shown)). In some embodiments (e.g., as shown in FIG. 1), one or more of the panels 55 comprise a grid of holes 60, with each hole being configured to receive a single bolt that is configured (as a single bolt) to couple a single hold (discussed below) to the wall 10. In some other embodiments, however, instead of using a single hole to couple a hold to the wall, one or more panels define (or are configured to define) two or more holes per hold, with such holes set forth in a grid pattern (much like as shown in FIG. 1, except with two holes being disposed next to each other and such pairs of holes being evenly spaced in the panel), in a grid pattern, in various locations that can be used to set up one or more climb paths, and/or in any other suitable location. Indeed, in some embodiments, the climbing wall defines two or more holes per hold location (e.g., to keep the holds from twisting around a single bolt (or other anchor mechanism)). In this regard, FIG. 21D shows an embodiment in which the climbing hold 200 is configured to couple to the climbing wall 10 (not shown in FIG. 21D) via two or more threaded members 220 (e.g., set screws, grabber screws, and/or any other suitable fasteners), such that the hold does not twist during use.

In some embodiments, each of the holes 60 comprise a T-nut, a nut, a threaded coupler, a mechanical engagement, and/or any other suitable coupler that is configured to couple a hold 200 to the climbing wall 10. Indeed, as mentioned above, in some cases, each hole comprises a T-nut that is configured to receive a bolt that extends through a hold. In some other cases, however, one or more of the holes comprise a sleeve, a washer, a sleeved washer, and/or any other suitable object that allows a screw, bolt, and/or other fastener to pass from a backside of the climbing surface 15, through such object (e.g., so as to not damage the climbing surface), and into a climbing hold. In some other embodiments, however, one or more of the holes each simply comprise a hole in a portion of the climbing wall (e.g., a pre-drilled or pre-formed hole and/or a hole formed at the time that a hold is coupled to the climbing wall).

Additionally, while the holes 60 (and/or any other suitable hold connection points) can be disposed in any suitable manner and with any suitable amount of space between them, FIG. 1 shows an embodiment in which the holes 60 are disposed in a grid and separated by about 20 cm. Again, however, the holes can be separated by any suitable distance or distances, with spacing between holes being relatively consistent and/or inconsistent. Indeed, in some other embodiments, holes (and/or any other suitable hold connections) are placed to match (or otherwise resemble) holds on a famous (and/or any other) rock formation. Moreover, in some embodiments, where the climbing wall defines pairs of holes in which two holes are relatively close to each other, such pairs of holes are disposed across (e.g., being evenly spaced; located in possible climbing path locations, even if not evenly spaced; and/or in any other suitable locations in) one or more portions of the climbing wall 10.

The climbing wall 10 can comprise any suitable number of panels 55, including 1, 2, 3, 4, 5, 6, 7, 8, 9, 10, or more. By way of non-limiting illustration, FIGS. 1 and 2 show some embodiments in which the climbing wall 10 comprises 6 panels 55.

The panels 55 can also be any suitable shape, including, without limitation, being square, rectangular, triangular, hexagonal, polygonal, irregular, symmetrical, asymmetrical, flat, contoured, volume, and/or any other suitable shape. By way of non-limiting illustration, FIGS. 1 and 2 show some embodiments in which the panels 55 are substantially flat and square in shape.

The panels 55 can be any suitable size. Indeed, in some embodiments, the panels have a width, height, and/or diameter that are between about 2 cm and about 8 meters (or within any subrange thereof). In at least some embodiments, the overall thickness of the panels, including the structure, is very small. In some embodiments, the panels create a three-dimensional structure, such as a boulder, protruding surface, or other structure upon which a climber can climb, wherein the entire three-dimensional surface is adjustable. Therefore, the walls of the three-dimensional structure (i.e., boulder, protruding surface, or other structure) has a much higher maximum, such as approximately 16-20 feet, and an overall length of approximately 100 feet. In such embodiments, the base member is accordingly larger to correspond with the size of the climbing surface.

Indeed, in some embodiments, the panels have a width and height that are between about 0.9 m and about 1.6 m. By way of non-limiting illustration, FIGS. 1 and 2 illustrate some embodiments in which some panels 55 are about 1.22 m×1.22 m while other panels 55 are about 1.32 m×1.32 m.

The climbing surface 15 can be any suitable size. Indeed, in some embodiments, the climbing surface has a height and width that are each between about 0.6 m and 12.2 m (or within any subrange thereof). Indeed, in some embodiments, the climbing surface has a height and width that are both between about 1.2 m and about 6 m. By way of non-limiting illustration, FIGS. 1 and 2 show some embodiments in which the climbing surface 15 has a height of about 3.65 m and a width of about 2.44 m.

With reference now to the base member 20, some embodiments of the climbing wall 10 optionally comprise the base member. While the base member can perform any suitable function, in some instances, it is configured to keep the climbing surface 15 disposed at any suitable height above a floor (which term may be used herein to refer to a floor, ground surface, support surface, and/or any other suitable surface), to anchor the climbing surface to the floor, to allow an angle of the climbing surface to be selectively adjusted, and/or for any other suitable purpose.

In some embodiments, the base member 20 is configured to keep the climbing surface 15 any suitable height above the floor and/or to help retain the climbing wall 10 in a desired location. With respect to holding the climbing surface above a floor, in some cases, the base member is configured to keep the climbing surface between about 1 cm and about 1 m (or any subrange thereof) above the floor.

Where the base member 20 is configured to retain the climbing surface 15 in a desired location (e.g., with respect to the floor and/or any other suitable object), the base member can perform such a function in any suitable manner, including, without limitation, by providing a surface that can be bolted, nailed, glued, clamped, pinned, stapled, frictionally attached, snapped, mechanically attached, fastened, weighted, placed against another object, cemented into, and/or otherwise anchored to a floor (and/or another suitable object). By way of non-limiting illustration, FIGS. 1-3 show some embodiments in which the base member 20 comprises one or more feet or other attachments 65 that are configured to be coupled to a floor (e.g., via one or more bolts, nails, adhesives, catches, anchors, rivets, and/or other suitable fastening methods).

Figure 3:
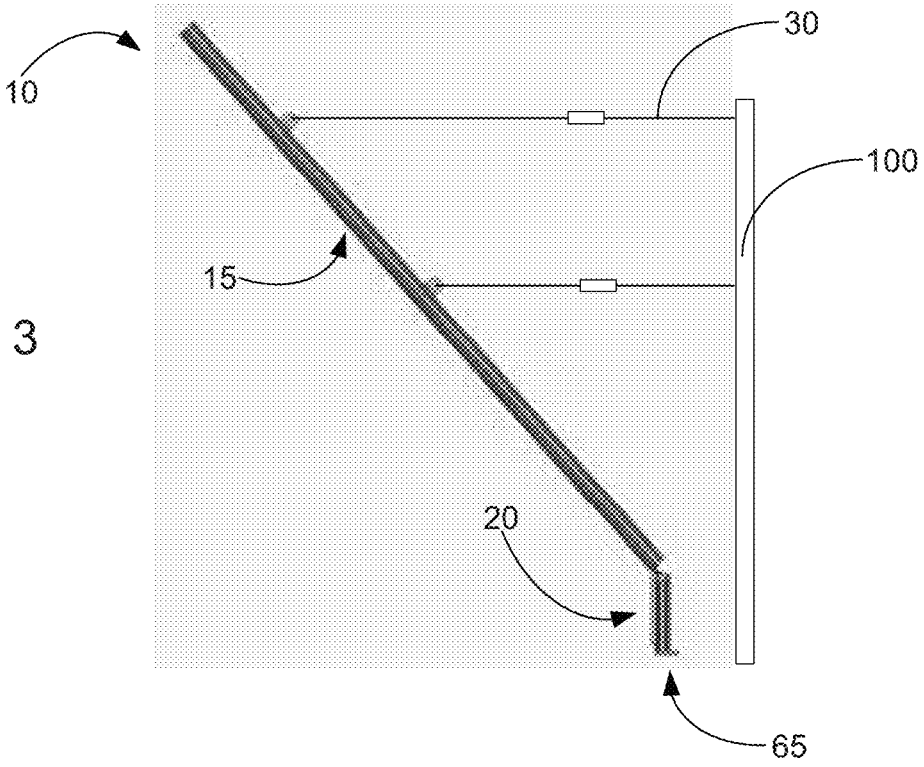
FIG. 3 illustrates a side view of a representative embodiment of the adjustable climbing wall.
Figure 4:
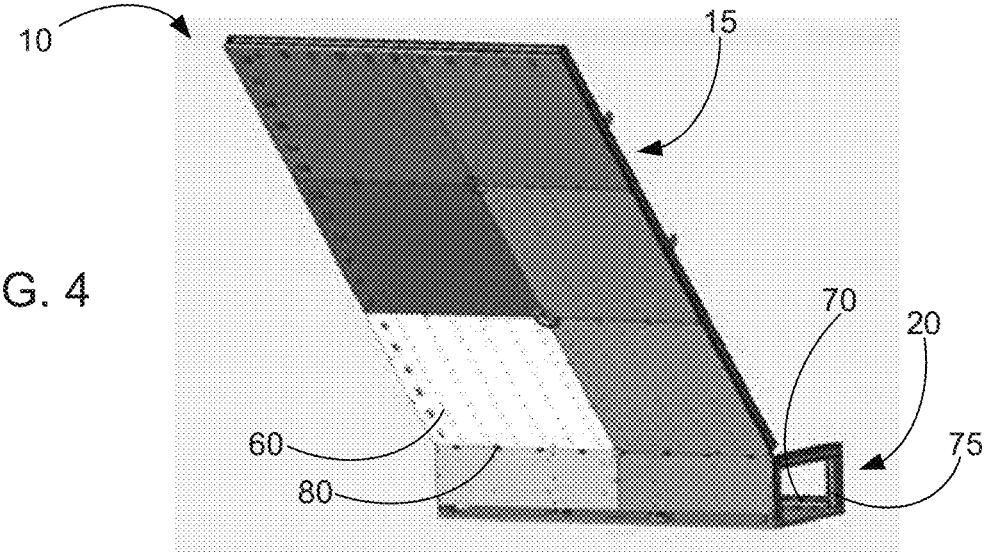
FIG. 4 illustrates a front perspective view of a representative embodiment of the adjustable climbing wall.
Figure 5:
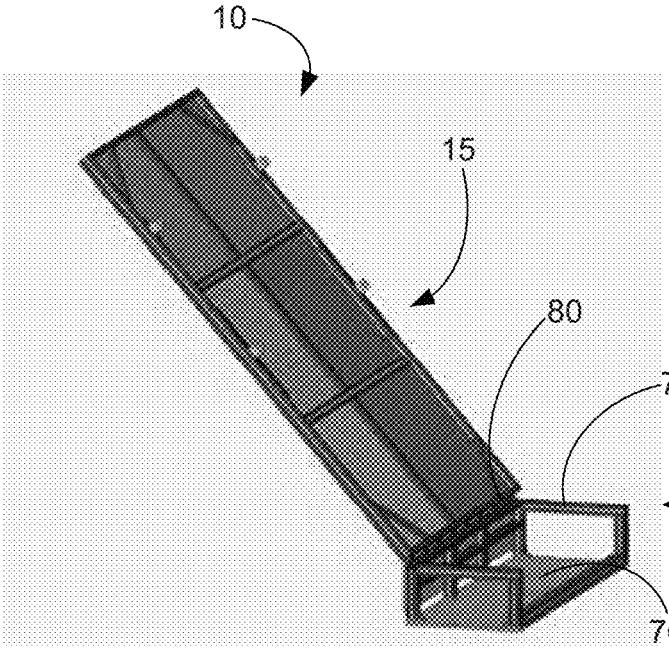
FIG. 5 illustrates a back perspective view of a representative embodiment of the adjustable climbing wall.
Figure 6:
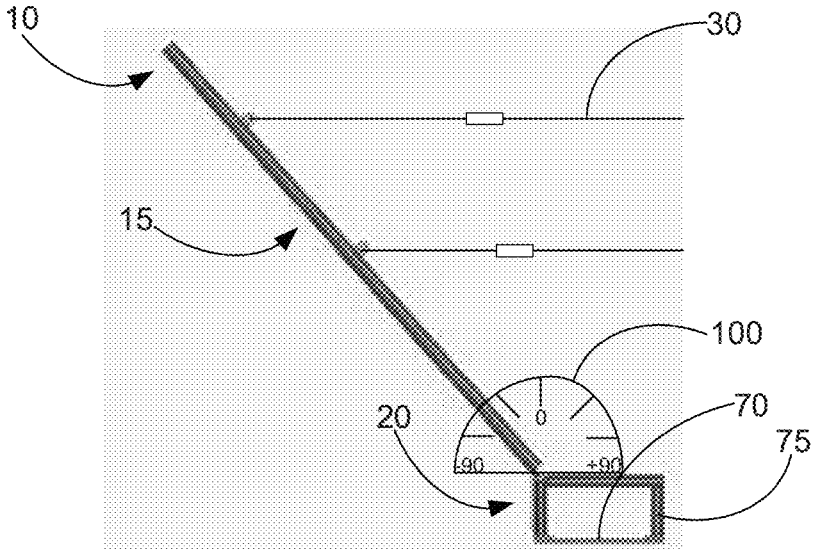
FIG. 6 illustrates a side view of a representative embodiment of the adjustable climbing wall.

In another non-limiting illustration, FIGS. 4-6 show some embodiments in which the base member 20 comprises a base section 70, edging 75, and/or is otherwise expanded from the base section 20 shown in FIGS. 1-3 so as to allow the base section to be: weighted down (e.g., by placing weights on the base section), rested against another object (e.g., a wall and/or any other support), fastened to a floor (e.g., via one or more bolts, nails, anchors, adhesives, and/or other suitable fastening mechanisms), and/or otherwise anchored down. Indeed, in some embodiments, the base member 20 of FIGS. 4-6 is weighted down (e.g., with sand bags, weights, and/or any suitable object) such that the weights can readily be removed to allow the climbing wall to be moved to a different location.

In addition to the aforementioned components, the base member 20 can have any other suitable shape or component. By way of example, although some embodiments of the base member do not comprise any climbing holds, some other embodiments do comprise permanent and/or replaceable holds.

Turning now to the pivoting members 25, the climbing wall 10 can comprise any suitable mechanism that is configured to allow an angle of the climbing surface 15 to be varied with respect the base member 20 and/or a floor. Some non-limiting examples of such pivoting mechanisms comprise one or more hinges (e.g., continuous hinges, piano hinges, gate hinges, strap hinges, t-hinges, butt hinges, butterfly hinges, pivot hinges, flush hinges, barrel hinges, industrial hinges, and/or any other suitable hinges or material to enable and allow the pivoting to function), straps, joints, couplers, motors, clamps, flexible members, springs, resilient members, and/or any other suitable type of pivotal coupling mechanisms. In some embodiments, there is a minimum of three hinge joints. Other embodiments include less or more than three hinge joints. Some embodiments include continuous hinge joints. By way of non-limiting illustration, FIGS. 1, 2, 4, and 5 show some embodiments in which the pivoting members 25 comprise multiple heavy-duty hinges 80.

The pivoting members 25 (e.g., hinges 80) can allow the climbing surface 15 to be adjusted to any suitable angle. Indeed, where the climbing surface is deemed to be at 0 degrees when a longitudinal axis of the panel is perfectly vertical, some embodiments of the climbing surface are configured to be moved to between +110 degrees to −110 degrees (or within any subrange thereof). In some cases, for instance, the climbing surface is configured to lean forward towards the climber (or overhang) between about 0 degrees and about −50 degrees.

With reference now to the supports 30, the climbing surface 15 of the climbing wall 10 can be selectively and/or permanently kept in (and/or moved to) one or more desired positions in any suitable manner, including, without limitation, through the use of one or more supports. In this regard, the supports can comprise any suitable component that is capable of helping to selectively hold the climbing surface 15 in one or more positions (e.g., with respect to a floor, the base member 20, and/or any other suitable object).

Figure 7:
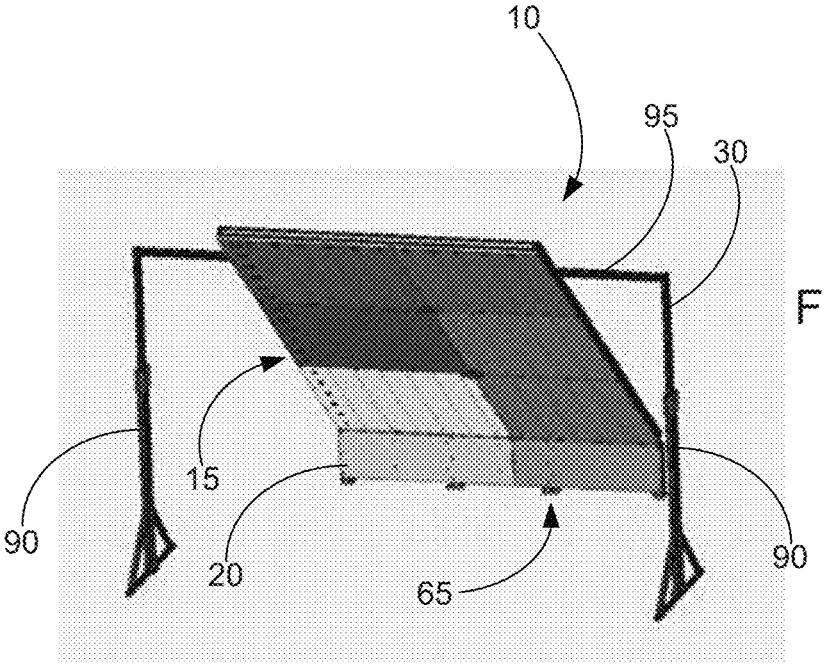
FIG. 7 illustrates a front perspective view of the adjustable climbing wall in which the climbing wall comprises a pair of support legs, in accordance with a representative embodiment.

Some non-limiting examples of suitable supports 30 include one or more cables, chains, come-alongs, hoists, ratcheting straps, ratchets, linear actuators, cable actuators, threaded rod actuators, actuators, servos, solenoids, pneumatic actuators, hydraulic actuators, winches, ratchet winches, hoists, straps, boards, arms, solid supports, bars, load bars, motors, pins, catches, springs, bungees, ropes, and/or other suitable supports. By way of non-limiting illustration, FIG. 1 shows an embodiment in which the supports 30 comprise one or more ratcheting straps 85, servos, actuators, come-alongs, and/or other suitable supports. In contrast, FIGS. 7-9 show some embodiments in which the supports 30 comprise one or more legs 90 and/or cross members 95.

Where the supports 30 comprise one or more legs 90 and/or cross members 95, such components can have any suitable characteristic that allows them to support the climbing surface 15 and/or to be used to selectively modify a position of the climbing surface. For instance, although in some embodiments the height of one or more connection points between the legs (e.g., one or more cross members and/or any other suitable connection points) and the climbing surface are fixed, in some other embodiments, the height of the connection points between the legs (e.g., the cross members) and the climbing surface are selectively variable.

Where a height of a connection point between the legs 90 and the climbing surface 15 is variable, the height of such connection point can be varied in any suitable manner, including, without limitation, by having multiple cross members at different heights to which the climbing surface can be attached, by being able to move the cross member to one or more different heights on the leg or legs, by being able to increase and/or decrease a height of the legs, by being able to connect the legs to different portions (e.g., lower and/or higher portions) of the climbing panel, and/or in any other suitable manner. In some embodiments, however, the height of the legs is configured to be adjusted (e.g., by each leg comprising: a servo, an actuator, a jack, a load bar, two pieces in which at least one piece defines a hole and the other piece defines a plurality of holes that allow the two pieces to be adjusted with respect to each other and a pin (or other object) to slide through some of the holes to selectively lock a position of the leg pieces with respect to each other, and/or by comprising any other suitable mechanism that is configured to adjust a height of the legs). By way of non-limiting illustration, FIGS. 7-9 show some embodiments in which a height of the legs 90 is configured to be adjusted (e.g., by sliding a pin through holes in at least two pieces of the legs and/or otherwise).

Where the supports 30 comprise one or more legs 90, the legs can be disposed in any suitable location that allows them to support the climbing surface 15, including, without limitation, being disposed between, at, and/or outside of the lateral edges of the climbing surface. By way of non-limiting illustration, FIGS. 7-9 show some embodiments in which the legs 90 are disposed lateral to the lateral edges of the climbing surface 15, with a cross member 95 extending between the legs and supporting the climbing surface.

Where the wall 10 comprises one or more legs 90 disposed laterally to one or more lateral sides of the climbing surface 15, the legs can be disposed any suitable distance from a corresponding lateral edge of the climbing surface, including, without limitation, between about 0.01 cm and about 3 m (or in any subrange thereof). Indeed, in some embodiments, each leg is disposed laterally between about 0.5 m and about 1.5 m (e.g., 75 m) from a corresponding lateral edge of the climbing wall. As a result, if a climber falls from the climbing surface, the climber can do so without hitting one or more of the legs.

Where the climbing wall 10 comprises one or more supports 30 (e.g., legs 90, ratcheting straps, etc.), the supports can be adjusted in any suitable manner and at any suitable time. Indeed, in some embodiments, the supports are manually adjustable (e.g., via one or more ratcheting mechanisms; by moving one or more connection points of a chain, cable, strap, and/or other support; by twisting a threaded engagement in a support; by moving adjusting a height or connection point of the legs; and/or in any other suitable manner), automatically adjustable (e.g., adjusted via one or more motors, servos, pistons, actuators, gear mechanisms, programs, voice commands, remote controls, and/or any other suitable mechanism), and/or in any other suitable manner. Indeed, in some embodiments, the wall 10 is manually adjusted. In other embodiments, the wall is configured to automatically adjust: as the climber moves to different holds on the wall, as directed by another entity (e.g., a training program; an exercise program; a trainer, competitor, or friend located with or remotely located away from the climber; and/or any other entity), based on the climber's climbing skills, and/or in any other suitable manner.

In some embodiments in which the climbing wall 10 comprises more than one support 30, multiple supports are configured to adjust an angle of the climbing surface 15 at the same time (e.g., synchronously). In some other embodiments, however, one or more supports are configured to be adjusted at different times (e.g., asynchronously). Thus, in some such latter embodiments, the supports can be used to not only adjust an angle of the climbing surface 15 with respect to a floor, but from side to side as well.

In some embodiments, the supports 30 are configured to allow the climbing panel 15 to be selectively moved to one or more of a fixed number of positions. Indeed, in some embodiments, the supports are configured to be used to hold the climbing panel in one or more incremental positions (to be moved in increments of 5 degrees, 10 degrees, and/or any other suitable increments). In some other embodiments, however, the supports are configured to allow the climbing panel to be moved to virtually any desired position and/or to an infinite number of positions (e.g., by adjusting the supports as much or as little as desired). Accordingly, in some such embodiments, the climbing wall 10 can be finely adjusted to multiple positions desired by one or more specific climbers.

Figure 10:
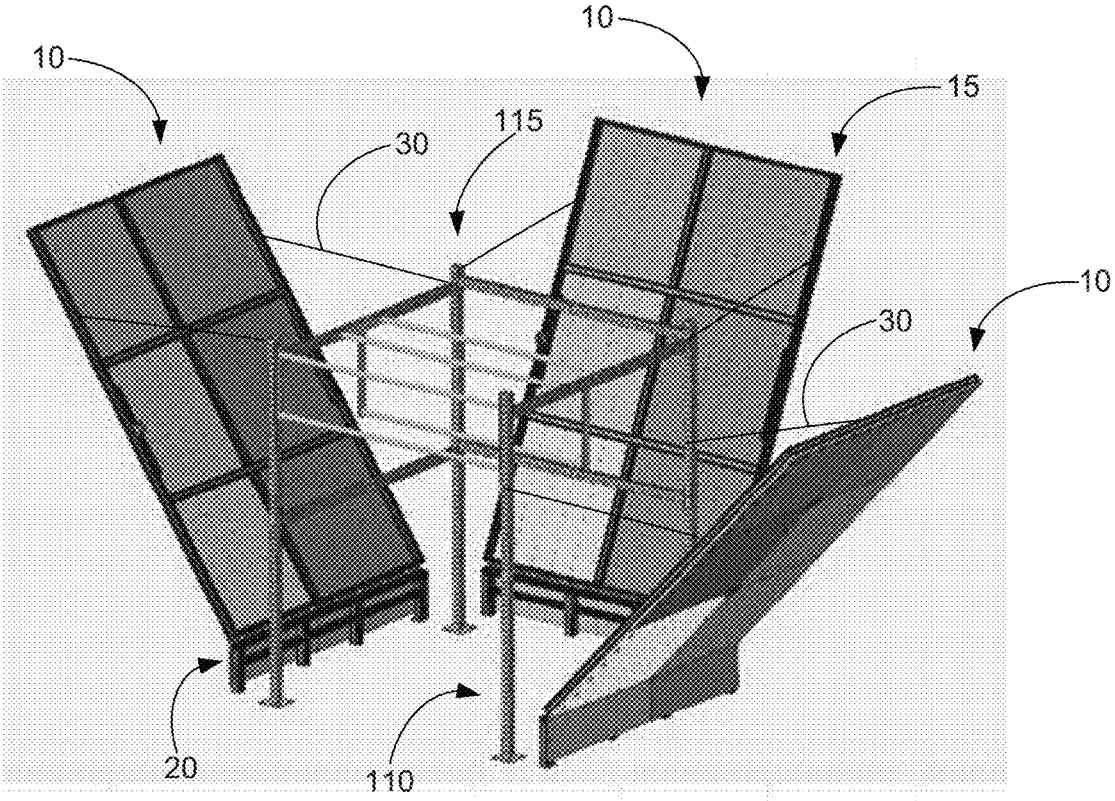
FIG. 10 illustrates a perspective view of multiple adjustable climbing walls that are coupled to a central frame in accordance with a representative embodiment.
Figure 11:
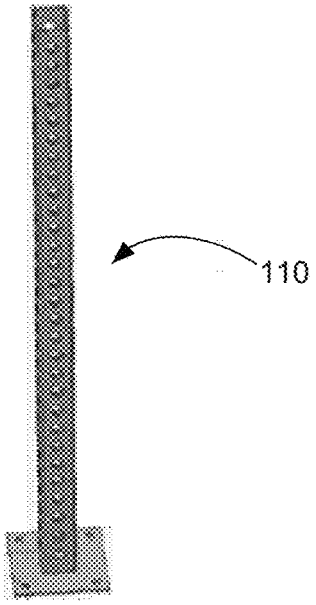
FIG. 11 illustrates a perspective view of a portion of a support object in accordance with a representative embodiment.

In order to hold the climbing surface 15 at a desired angle, the supports 30 can be coupled to, rest on, braced against, and/or otherwise interact with any suitable support surface or object. Indeed, in some embodiments, the supports are coupled to or rest on (directly or indirectly) one or more walls, pillars, floors, frames, frameworks, braces, vehicles, trees, fences, support surfaces, posts, scaffolds, structures, power racks, power cages, squat cages, squat racks, benches, weight lifting racks, weight lifting systems, and/or any other suitable object that is capable of supporting the climbing wall 10 and/or a climber on the wall. By way of non-limiting illustration, FIG. 3 shows an embodiment in which climbing surface 15 is anchored by one or more supports 30 to a wall 100, a post, and/or any other suitable support object that is capable of supporting the climbing wall 10. In another illustration, however, FIGS. 10-11 shows some embodiments in which one or more climbing walls 10 are coupled or configured to couple (e.g., via one or more supports) to a frame (e.g., one or more posts 110, power racks 115, and/or any other suitable support structure).

In addition to the aforementioned components, the described climbing wall 10 can have any other suitable component that allows it to function as intended. In one example, some embodiments of the climbing wall optionally comprise one or more mechanisms for indicating an angle of the climbing surface 15. In this regard, the wall can comprise any suitable mechanism that is capable of performing such a function, including, without limitation, one or more inclinometers, baseline bubble inclinometers, tilt gauges, digital gauges, smart phones or other electronic devices comprising an inclinometer, magnetic levels, magnetic angle finders, clinometers, pitch locators, slope locators, tube inclinometers, satellite inclinometers, protractors, markings and/or meters on various positions or connection points for the supports 30 (showing various angles that are achieved when the supports are adjusted), and/or any other suitable mechanism. By way of non-limiting illustration, FIG. 6 shows an embodiment in which the climbing wall 10 comprises a protractor 100 (and/or any other suitable inclinometer). In some other embodiments (not shown), the wall comprises a holder for cell phone, tablet, and/or other electronic device that is capable of indicating an angle of the climbing surface. In still other embodiments (not shown), the climbing wall has a built in digital display that indicates the angle of the climbing surface.

Figure 12:
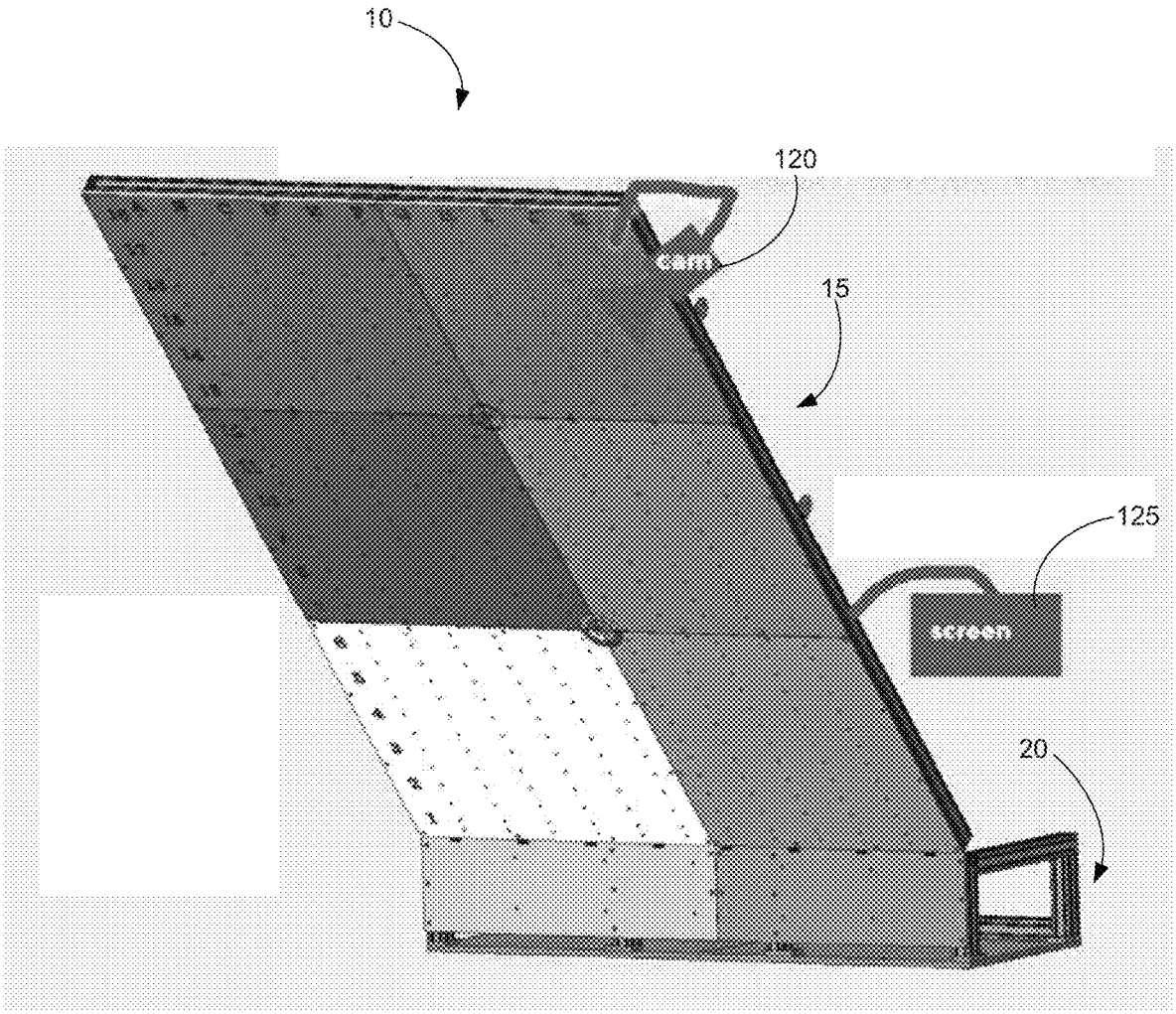
FIG. 12 illustrates a front perspective view of the adjustable climbing wall in accordance with a representative embodiment.
Figure 13:
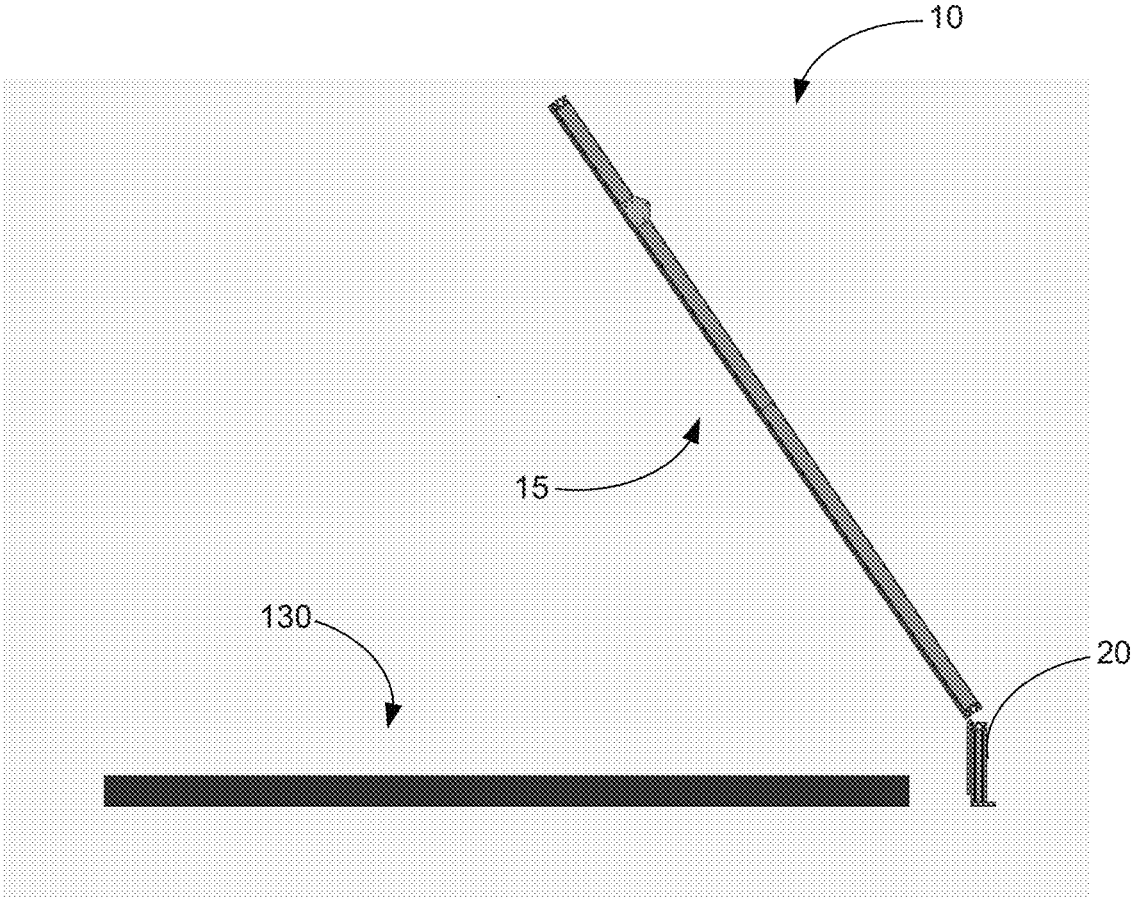
Figure 14:
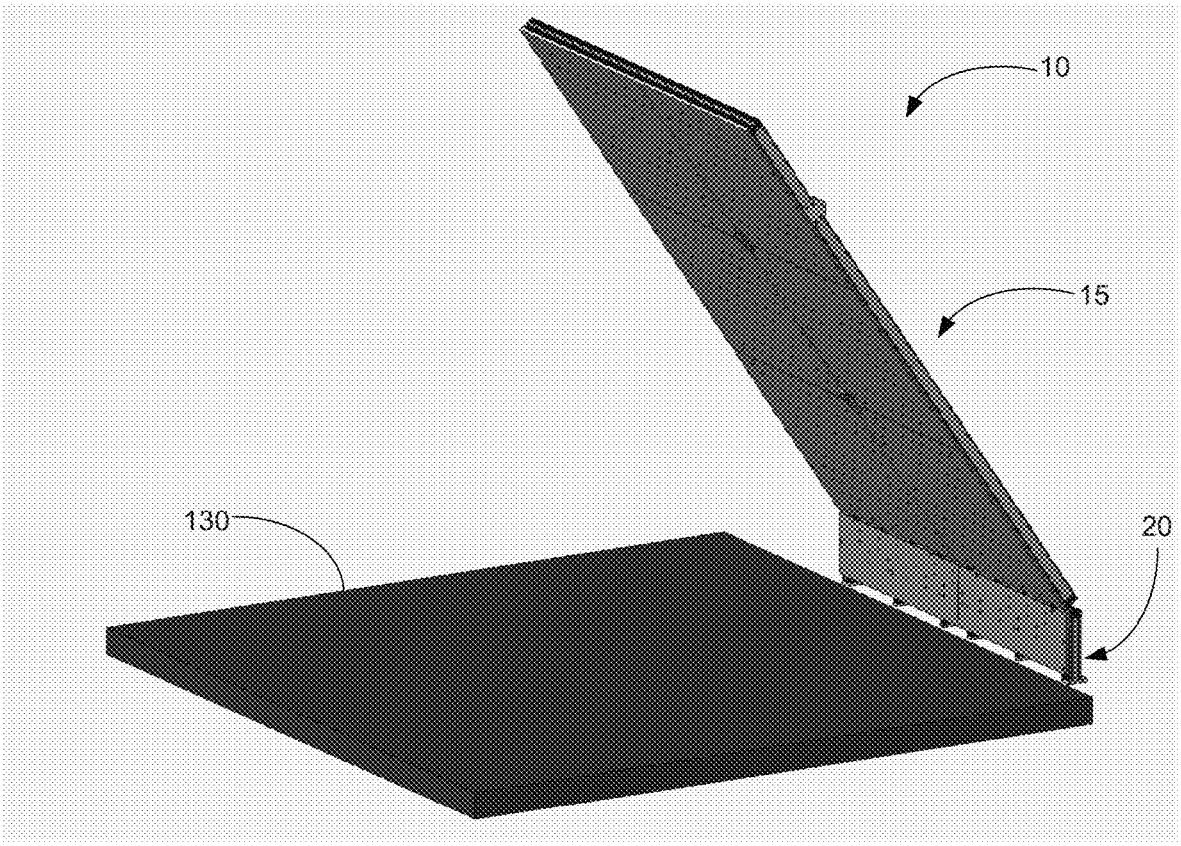
Figure 15:
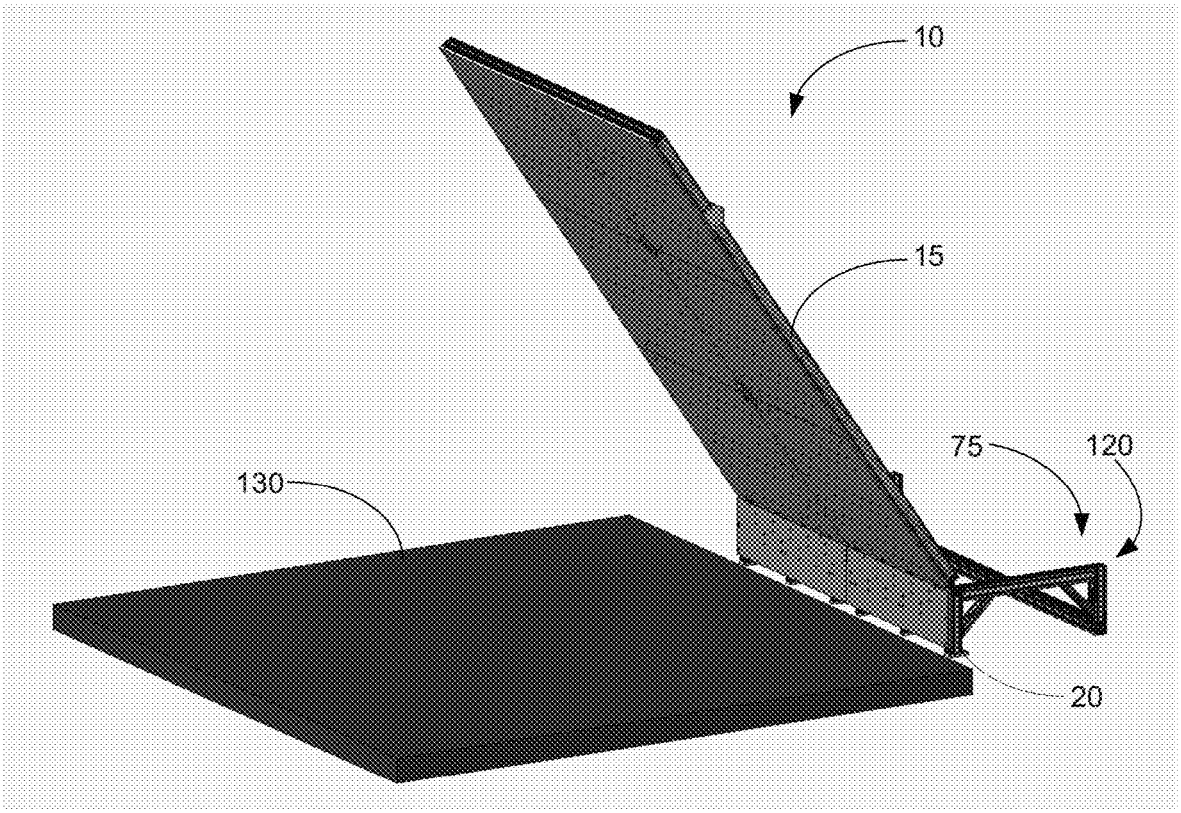

In some embodiments, the climbing wall 10 comprises (and/or is otherwise associated with) one or more cameras and/or microphones that are configured to capture images and/or audio of a person (e.g., a climber and/or a trainer on or near the climbing wall). In some such embodiments, the camera and/or microphone can be used to: record a climber's climbs, transmit the climber's climbs and/or conversations to another location (e.g., a trainer, a competitor, a friend, etc.), analyze a climber's climbs, and/or for any other suitable purpose. Indeed, in some embodiments, such camera allows the climber to interact in near real-time with another person (e.g., a trainer and/or friend) in another location. While such a camera and/or microphone can be disposed in any suitable location, in some embodiments, they are coupled to the climbing surface 15 (e.g., as shown by the camera 120 in FIG. 12), one or more legs 90, one or more stands, the floor, and/or in any other location.

As another example of a suitable component of the climbing wall 10, some embodiments of the climbing wall optionally comprise one or more displays and/or speakers that allow a climber to watch video from another climber on another climbing wall; to watch a training video; to receive instructions on how to climb; to watch the climber climb from the view of one or more cameras 120; to watch TV (or any video material); to watch nature scenes; to program the wall (e.g., supports 30) via a touchscreen and/or in any other suitable manner; to speak to or otherwise communicate with another climber (or person) in a different location; to hear music, nature sounds, and/or any other sounds; and/or for any other purpose. Indeed, in some embodiments, such a display allows a climber to watch, receive feedback from, and/or otherwise communicate with another person (e.g., a trainer) in another location. While such displays can be disposed in any suitable location, in some embodiments, they are coupled to the climbing surface 15 (e.g., as shown by the display 125 in FIG. 12), one or more legs 90, one or more stands, the floor, and/or in any other location.

As another example of a suitable component, some embodiments of the climbing wall 10 comprise one or more indicators that are configured to: identify different holds the climber should, could, and/or has used; different routes or circuits a climber could follow, holds that have been used a climber in another location (a climber on another wall), the complexity of different routes, and/or to otherwise perform any other suitable function. In this regard, the indicators can comprise any suitable component that is capable of performing such a function. In some embodiments, the route shown by the indicators changes based upon a climb. Accordingly, in some embodiments, once a climb of a route shown by the indicators is complete, the system provides a different or more challenging route shown by the indicators to allow the climber to move to the next climb/route. Alternatively, if a route is unable to be completed, the route can continue to be shown to allow the climber to master the route, or a less challenging route is provided to match the ability of the climber. Accordingly, in some embodiments, the system dynamically uses routes shown by components or indicators that enable a climber to improve his/her climbing ability and skill.

Some non-limiting examples of such components include one or more lights, light sources, LEDs, multicolor LEDs, LCDs, digital displays, speakers, buzzers, haptic vibrators, and/or any other suitable indicators. Indeed, in some embodiments, the climbing wall 10 has one or more LEDs that are associated with one or more climbing holds 200 and/or possible hold locations on the climbing wall.

In some embodiments, the walls are transparent, translucent, and/or perforated to allow light from a single and/or multiple source LED to backlight the holds 200. Accordingly, this LED illumination of holds can be used to create routes and is able to be implemented on large scale climbing walls. Indeed, in some embodiments, one or more light sources, LEDs, multicolor LEDs, LCDs, digital displays, speakers, buzzers, haptic vibrators, and/or any other suitable indicators are disposed in and/or on one or more portions of the climbing wall 10 so as to be closed to (and/or humanly perceptible at) one or more holds on the wall.

In some embodiments, however, one or more of the holds 200 comprise one or more light sources, LEDs, multicolor LEDs, LCDs, digital displays, speakers, haptic vibrators, and/or any other suitable indicators to: identify possible climbing courses, indicate which hold should be used next, indicate which holds have been used, track a climber's path, indicate the holds that another climber is currently using and/or has used, indicate which holds are part of a particular climbing path, indicate the difficulty of a particular hold and/or climbing path, and/or for any other suitable purpose. In some such embodiments, one or more of the holds comprise one or more such light sources (e.g., LEDs, incandescent lights, and/or any other suitable lights sources).

Where a hold 200 comprises a light source, the light source can be disposed at any suitable portion of the hold, including, without limitation, in a center of the hold, being offset from a center of the hold, being in a hole that is typically used to bolt the hold to a climbing surface, at a perimeter of the hold, at a backside of the hold, within the hold, and/or in any other suitable location. In some cases, however, the light source is disposed in a central hole of the hold (e.g., in a hole that is typically formed in the hold to receive a bolt (or other fastener) to secure the hold to a surface (e.g., the climbing panel)). By way of non-limiting illustration, FIGS. 21B-21E show some embodiments in which the hold 200 comprises one or more light sources 205 that are disposed in a hole 210 that extends through the hold (e.g., a central hole).

In some cases in which one or more holds 200 comprise one or more light sources 205, the holds optionally comprise one or more lenses to cover, protect, diffuse light from, and/or otherwise cover the light source(s). In some such cases, the lens is recessed within the hold. In some other cases, however, a portion of the lens and/or the light source itself extends from the hold, is convex, and/or is otherwise configured to be readily visible when a climber is in various locations with respect to the hold (e.g., above, below, to a side of, at an angle to, and/or at any other suitable location with respect to the hold). By way of non-limiting illustration, FIGS. 21B-21E show some embodiments in which the hold 200 comprises a lens 215 (e.g., a convex lens and/or any other suitably shaped lens).

Regardless of where the indicators (e.g., one or more LEDs, light sources, vibrators, and/or other suitable indicators) are located, the indicators can be controlled in any suitable manner. Indeed, in some embodiments, the indicators identify the holds that a climber has used. In such embodiments, the indicators can identify the holds in any suitable manner, including, without limitation, by turning on (and/or otherwise providing an indication related to one or more holds) once a sensor (as discussed below) indicates that a climber has touched or otherwise used on a hold.

In some other embodiments, the indicators (e.g., LEDs) are controlled by a program that shows the climber a proposed route before, during, and/or after a climber climbs the wall 10. In some embodiments, circuits can be created with the program. Indeed, although in some embodiments, all of the indicators of a route are lit before and/or while a climber is on the wall, in some other embodiments, an indicator relating to a specific hold lights up (and/or otherwise identifies the next hold) once the climber has used a prior hold.

In some embodiments, a person in a remote location is able to control the indicators on the wall 10. In this regard, the person in the remote location can control the indicators in any suitable way (e.g., by selecting specific indicators or routes on a touchscreen, by selecting routes and/or specific indicators with an input device, by selecting one or more programs to be run on the wall, and/or in any other suitable manner). Indeed, in some embodiments, as a first person in a first location climbs a first embodiment of the wall, sensors (e.g., touch sensors, pressure sensors, photo sensors, and/or any other suitable type of sensors) on the first embodiment cause indicators on a second embodiment of the wall to light up (and/or to otherwise provide an indication) to identify corresponding holds on the second embodiment of the wall. Accordingly, some embodiments of the described wall allow users to compete against each other, to train each other, and/or to otherwise interact with each other.

In some embodiments, each indicator is individually controlled by a switch associated with that indicator (e.g., a switch that turns on and off a light in the hold 200). By way of non-limiting illustration, FIG. 21D shows an embodiment in which the light source 205 of the hold 200 is controlled by a switch 235 on the hold 200.

In some embodiments, one switch controls multiple indicators (e.g., a switch is used to selectively turn on and off multiple lights indicating a climbing path). In some other embodiments, one or more indicators are configured to be controlled by one or more processors (e.g., such as the representative operating environment discussed below). Additionally, in some embodiments, one or more indicators are controlled by a processor, one or more programs, one or more sensors, one or more devices in a remote location, and/or in any other suitable manner.

Where the indicators (e.g., light sources, haptic vibrators, etc.) are controlled by a processor and/or any other suitable controller, such indicators can be in signal communication with the processor and/or other controller in any suitable manner. Indeed, in some embodiments, the indicators are in wired communication with one or more processors and/or controllers. In some other embodiments, however, one or more indicators are configured to be in signal communication with one or more processors and/or controllers via a wireless communication (e.g., via one or more internet connections, modems, BLUETOOTH™ communication systems, WiFi connections, cellular connections, wireless links, and/or other adapters for connection to a local and/or wide area network ("WAN")). Indeed, in some embodiments, one or more holds having one or more indicators are configured to communicate with a processor via BLUETOOTH™ communication. By way of non-limiting illustration, FIG. 21D shows an embodiment in which the hold 200 comprises a BLUETOOTH™ communications link 225.

Where the climbing wall 10 and/or one or more holds 200 comprise one or more indicators (e.g., LEDs, light sources, and/or other indicators), the indicators can be powered in any suitable manner. Indeed, in some embodiments, each indicator is powered by the same power source (e.g., the mains, one or more common batteries, and/or any other common power source). Indeed, in some embodiments, when a hold comprising an LED is coupled to the climbing wall 10, the hold (e.g., the light source and/or other indicator of the hold) is coupled to a power source via one or more plugs, wires, connectors, electrical couplers, electrical contacts, and/or in any other suitable manner.

In some other embodiments, however, one or more holds 200 each comprise their own power source (e.g., one or more batteries, solar cells, and/or any other suitable power source). By way of non-limiting illustration, FIG. 21D shows an embodiment in which the hold 200 comprises a battery 230 that is in electrical communication with the light source 205.

Additionally, in some embodiments, the one or more climbing holds 200 is associated with a haptic vibrator (e.g., to indicate that climber has used a hold for too long, to indicate that a climber is not using the right hold, to indicate that another climber has or has not used that hold (e.g., a climber on a second climbing wall in signal communication with a first climbing wall), and/or for any other suitable purpose).

As another example of a suitable component, some embodiments of the climbing wall 10 comprise (or are otherwise associated with) a projector that projects images (e.g., images of natural rock, potential climbing routes, and/or any other suitable image) onto the climbing surface 15. In still other embodiments, the climbing surface and/or the climbing panels 55 comprise one or more displays (e.g., TVs, monitors, screens being projected on by one or more projectors located behind the climbing surface, and/or any other suitable type of display) to allow the climbing surface: to visually resemble a natural and/or artificial formation, to watch another climber on another climbing wall climb, to display possible paths, and/or to show any other suitable image. Indeed, in some embodiments, the climbing wall comprises one or more displays behind a transparent material (e.g., plastic, glass, etc.) comprising climbing holds.

As yet another example of a suitable component, some embodiments of the climbing wall 10 comprise one or more sensors that are configured to determine which holds 200 a user has used, how much weight a user has placed on a hold, how long a user used a hold 200, how wet a hold is, when to turn on an indicator, to otherwise obtain any other suitable information regarding the climbing wall and/or one or more climbers' climbs, and/or to otherwise observe and/or control one or more aspects of the wall. In this regard, the climbing wall (and/or hold) can comprise any suitable type of sensor, including, without limitation, one or more touch sensors, weight sensors, piezoelectric sensors, temperature sensors, IR sensors, proximity sensors, ultrasonic sensors, pressure sensors, wire resistive sensors, surface capacitive sensors, projected capacitive sensors, surface acoustic wave sensors, and/or any other suitable sensors.

While the sensors can be disposed in any suitable location (e.g., at any suitable portion of the climbing wall 10), in some embodiments, the sensors are associated with one or more holds 200. By way of non-limiting illustration, FIG. 21D shows an embodiment in the hold 200 comprises one or more sensors 240.

In accordance with some embodiments in which one or more holds 200 comprise one or more sensors 240, the climbing wall 10 is configured to track which holds a climber has used, to track a climber's progress, to light up LEDs (or otherwise control one or more indicators) on another climbing wall (e.g., for competition purposes, for training purposes, and/or any other suitable purpose), to determine an amount of weight a user puts on the hold, to determine how long a user was in contact with the hold, and/or for any other suitable purpose. Indeed, in some embodiments, the sensors readings are recorded (e.g., via a processor and/or memory associated with the climbing wall and/or hold) to track routes, to determine progress, to provide adaptive and/or personalized training, etc. Additionally, in some embodiments, sensor readings are transmitted (e.g., via a network interface, as discussed below) to a different location (e.g., a separate climbing wall) to allow a second climber to track the movements of a first climber and/or vice versa.

In some embodiments, one or more climbing holds on the wall 10 are configured to rotate (e.g., automatically and/or manually) to change a difficulty of the wall, to keep a climber from using a hold, to force a climber to solve problems, and/or for any other suitable purpose. Indeed, in some embodiments, one or more holds on the climbing wall are associated with one or more motors, servos, actuators, and/or other mechanisms that are configured to selective rotate (or otherwise move) such holds.

In some embodiments, the climbing wall 10 comprises a treadmill climbing surface 15 that allows the climbing surface to rotate in a loop (or other suitable shape) as a climber moves from hold to hold. In this regard, the climbing wall can comprise any suitable component that allows it to function, including, without limitation, any other component disclosed herein, one or more brakes, one or more motors, one or more speed controls, one or more speed and/or movement sensors, and/or any other suitable component.

As another example of a suitable component, some embodiments of the climbing wall 10 comprise one or more training programs that are configured to help a climber learn new routes, learn new techniques, and/or otherwise be trained. In some embodiments, such a program is run on computer (e.g., as discussed below) that is associated with the climbing wall. Moreover, in some embodiments, the program is configured to receive information on the climber (e.g., from wearable sensors, such as heart sensors; from sensors associated with holds on the climbing wall; from a camera associated with the wall; from a touchscreen, keyboard, remote control, voice command, and/or from any other suitable source). In some such embodiments, the program is configured to adapt to the needs and/or desires of the climber, a trainer, and/or to otherwise adapt. Indeed, in some embodiments, the program is configured to: automatically change an angle of the climbing surface 15 (e.g., on the fly, as part of a preset program, and/or otherwise); rotate one or more holds; to increase, decrease, and/or stop rotate of a the climbing surface where the climbing surface comprises a treadmill wall; activate different indicators (e.g., LEDs) based on specific needs, performance, program parameters, and/or any other suitable factor; and/or to otherwise vary the wall.

Although in some embodiments, the climbing wall 10 comprises a single climbing surface 15, in some other embodiments, the wall comprises multiple climbing surfaces. In some such embodiments, each of the climbing surfaces is configured to be moved together. In some other embodiments, however, the various climbing surfaces are configured to be moved to various positions (or angles) independent of one or more other climbing surfaces. In this manner, the wall can be used to vary the intensity of climbing routes and/or to otherwise vary the climbing wall.

Where the climbing wall 10 comprises more than one climbing surface 15, the climbing wall can have any suitable component or characteristic that allows it to function as intended. Indeed, in some embodiments, the wall comprises one or more pinch sensors (e.g., to ensure that a portion of a climber's body, clothing, gear, etc. is not pinched or scissored between the edges of two adjacent climbing surfaces). In some embodiments, one or more climbing surfaces comprise a skirt or other protector that extends backwards and at an edge from the climbing surfaces (e.g., again, to ensure that a portion of a climber's body, clothing, gear, etc. is not pinched or scissored between the edges of two adjacent climbing surfaces).

Although in some embodiments (e.g., as shown in FIGS. 1-10 and 12), each of the individual climbing panels 55 are in a fixed or static position with respect to the climbing surface 15, in some other embodiments, one or more panels in the climbing surface are configured to selectively move (e.g., automatically and/or manually via one or more supports 30 and/or other suitable mechanisms) with respect to the climbing surface. In this regard, the individual climbing panels can be configured to move in any suitable manner, including without limitation, by extending out of the climbing surface, moving deeper into the climbing surface, pivoting, and/or otherwise moving. For instance, where a climbing panel comprises at least a portion of a three-dimensional cube, the cube can move out and/or into the climbing surface. Additionally, where a climbing panel comprises a three-dimensional sector shape object, such a panel can pivot with respect to a portion of the climbing surface to expose a three-dimensional volume.

As still another example of a suitable component, some embodiments of the climbing wall 10 comprise one or more fans (e.g., to cool the climber, to mimic natural breezes, to dissipate fragrances, and/or for any other suitable purpose); essential oil diffusers, fragrance printer, and/or other smell outputs (e.g., to release certain smells at certain times); misters, drip hoses, hoses, spray nozzles, pumps, and/or other apparatus that are configured to provide moisture to the climbing wall and/or the climber (e.g., to cool a climber and/or to mimic dew, natural springs, rain, and/or other water hazards that may be encountered when climbing in nature); speakers (e.g., to provide music, nature sounds, and/or any other suitable sound); and/or any other suitable feature that can increase a climber's sensory experience while using a wall. Indeed, in some embodiments, the wall comprises one or more smell out puts that are configured to release one or more smells (e.g., a smell of a sea breeze, pine, moss, sage, and/or any other suitable smell) at a desired time (e.g., when a specific sensor is engaged, when the climber reaches the "summit," as controlled by a program, and/or at any other suitable time.

In still another example of a suitable component, some embodiments of the wall 10 are used with one or more mats (see e.g., mats 130 in FIGS. 13-19). In this regard, the mats can have any suitable characteristic that allows them to cushion falls and/or otherwise make use of the wall safer and/or more comfortable. Indeed, the mats can be any suitable size, including, without limitation, being between about 0.1 m and about 20 m, or any subrange thereof (e.g., about 3.9 m×about 3.9 m).

In addition to the described modifications, the climbing wall 10 can be modified in any suitable manner. In one example, the climbing surface is pivotally attached directly to a floor without the base member 20 being disposed between the two.

Figure 16:
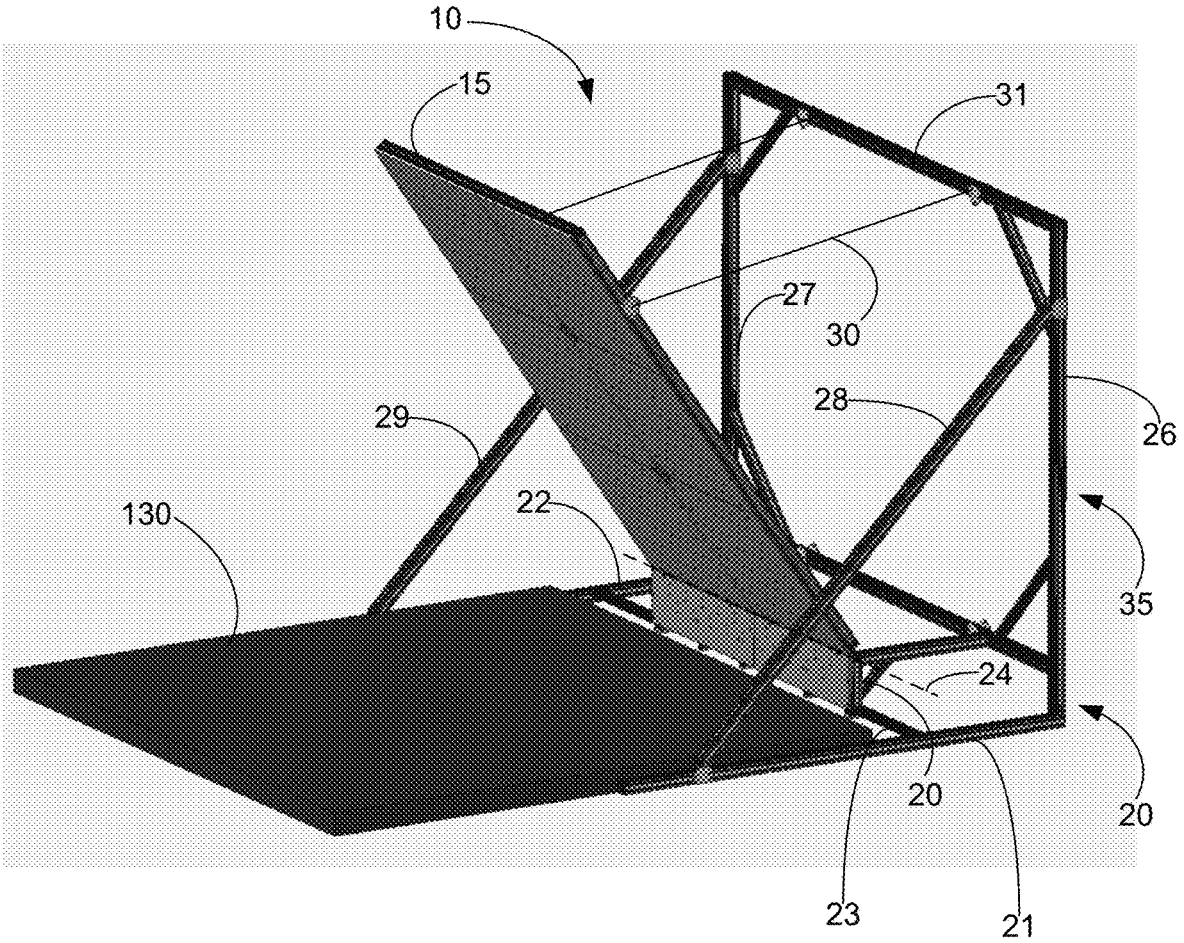
Figure 17:
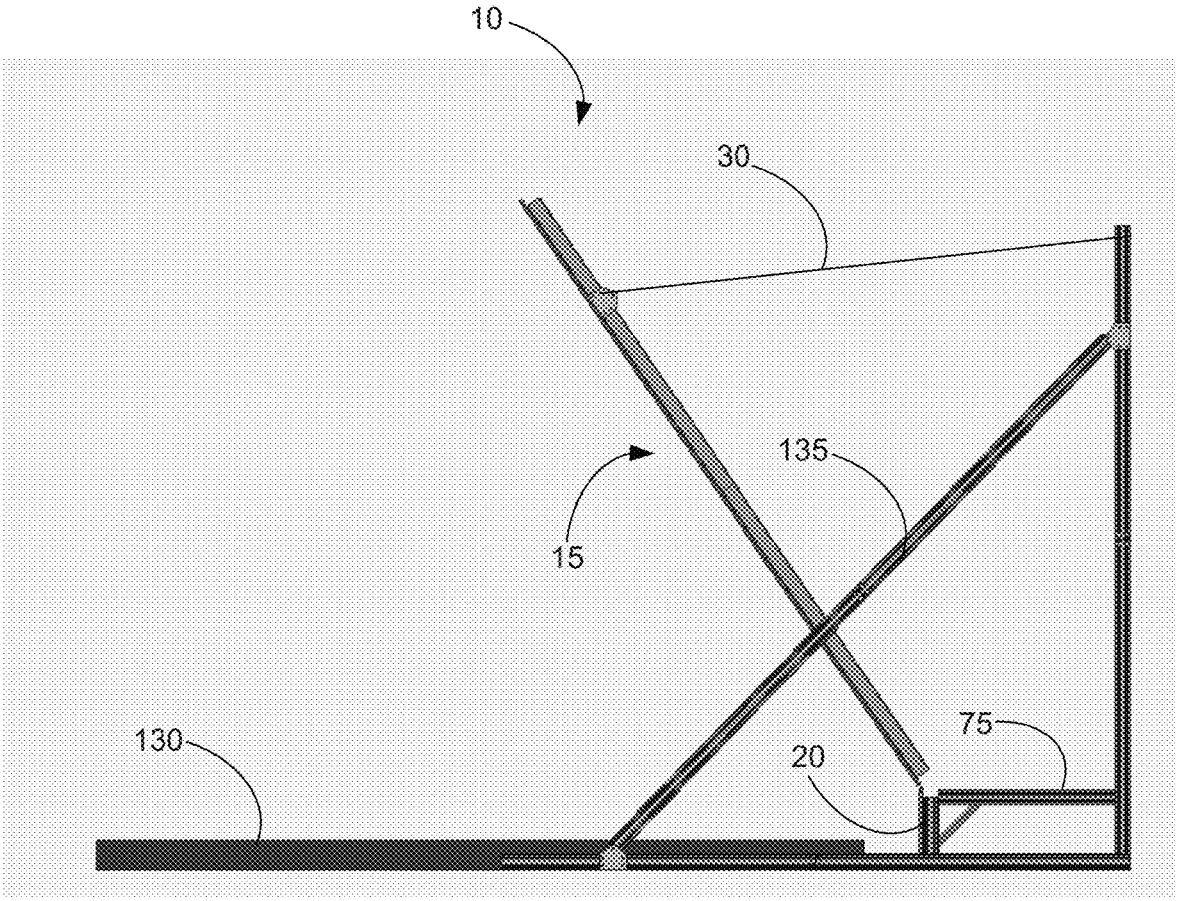
Figure 18:
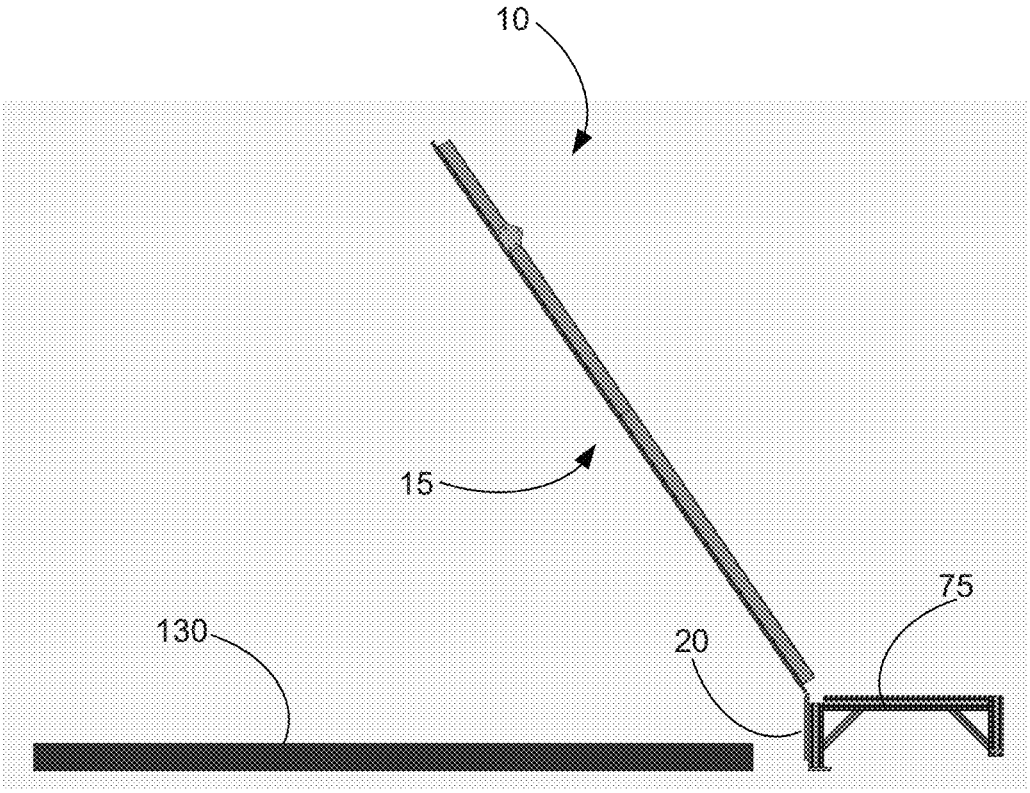
Figure 19:
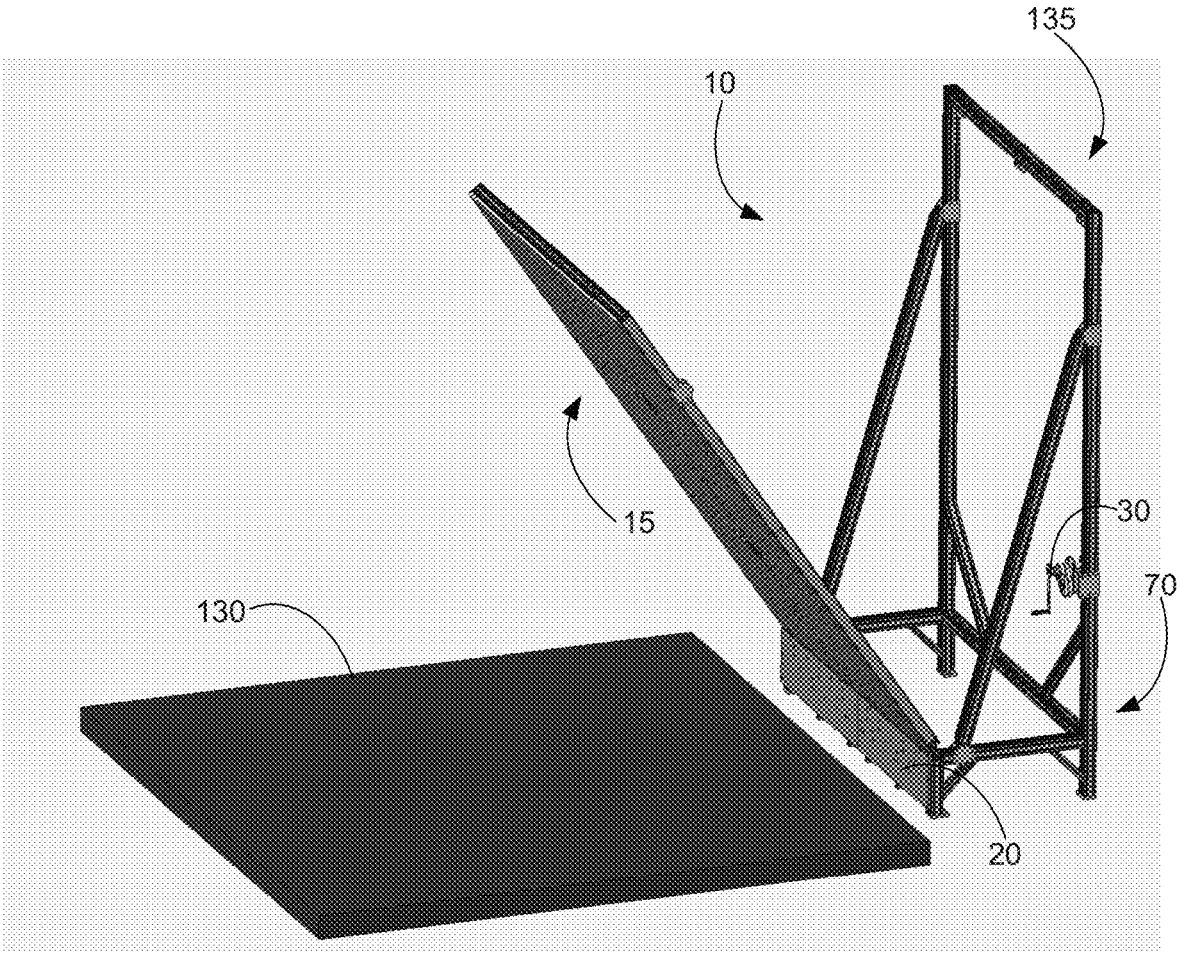
Figure 20:
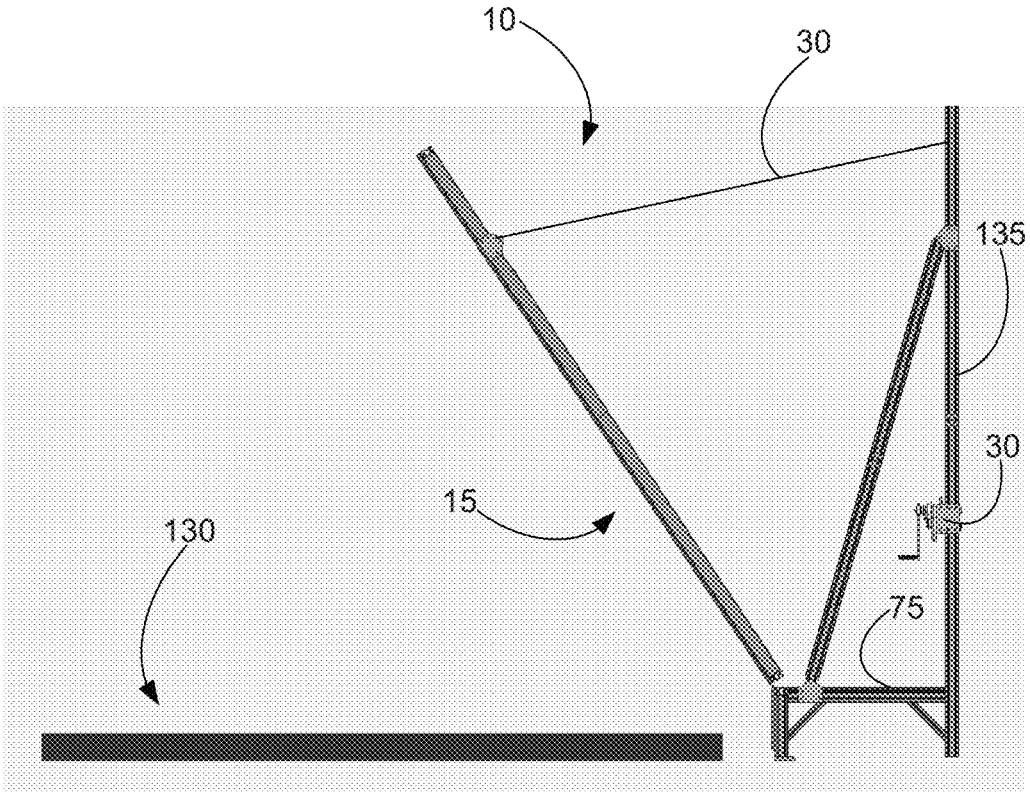

In another example, the base member 20 and/or base section 70 can have any suitable shape that allows the climbing surface 15 to be supported. By way of non-limiting illustration, FIGS. 16, 17, 19, 20, and 21 show some embodiments in which the base member and/or the base section 70 are coupled to and/or otherwise comprise a framework 135 that is configured to support the climbing surface 15 and/or supports 30. Accordingly, in some such embodiments, the climbing wall 10 comprises a self-supporting unit that does not require the climbing surface 15 to further be anchored to another support object (e.g., a wall). Additionally, FIG. 16 shows that, in some embodiments, the wall 10 comprises a first horizontal support 21, a second horizontal support 22, a transverse member 23, a pivot axis 24, of the pivot member 25, a first frame member 26, a second frame member 27, a third frame member 28, a fourth frame member 29, and a crosspiece 31.

The described climbing walls 10 can comprise any suitable materials that allow it to function as intended. Indeed, in some embodiments, the frame 35 comprises one or more metals (e.g., pieces of aluminum, steel, iron, magnesium, metal alloy, and/or any other suitable type of metal), plastics, fiberglass, wood, ceramic materials, natural materials, synthetic materials, and/or any other suitable materials. Indeed, in some embodiments, the frame comprises aluminum.

With respect to the climbing panels 55, the panels can comprise any suitable material, including, without limitation, one or more types of wood (i.e., plywood, oriented strand board (OSB), particle board, medium density fiberboard (MDF), fiberboard, and/or other suitable type of wood), plastic (e.g., polyethylene, high density polyethylene plastic, polypropylene, polyvinyl chloride, pvc sheet board, recycled plastic plywood (e.g., EKOPLY™ materials), metal, and/or any other suitable plastic), plastic coated plywood, nylon, resin, plaster, rubber, polymers, laminate, fiberglass, stone, natural materials, acrylic polymer, alumina trihydrate, rubber, thermoplastic, fabric, leather, conveyor belt (e.g., for a treadmill wall), and/or other suitable materials. Indeed, in some embodiments, the panels comprise plywood, OSB, MDF, and/or recycled plastic plywood.

The described climbing walls 10 can also be made in any suitable manner. In this regard, some non-limiting examples of methods for making the described climbing walls include, cutting, folding, bending, molding, shaping, extruding, drilling, using a computer numerical control device, connecting various pieces with one or more adhesives, mechanical fasteners (e.g., clamps, rivets, crimps, pins, brads, nails, staples, pegs, clips, screws, bolts, threaded attachments, couplers, etc.), 3D printing, computerized numerical control (CNC), additive manufacturing, welding pieces together, connecting pieces together, and/or any other suitable method that allows the described climbing walls to perform their intended functions. In some embodiments, the climbing panels 55 are made with a CNC cutting tool.

In addition to the aforementioned features, the described climbing wall 10 can have any other suitable feature. Indeed, in some embodiments, the climbing wall can be relatively easy to assemble (e.g., allowing one or more people to assemble it with relatively few tools, such as an Allen wrench, a screw driver, etc.). In some embodiments, the wall can be assembled in a relatively short period of time. In still other embodiments, the wall can weigh relatively little. Indeed, while some competing artificial rock walls can weigh hundreds of kg (kilograms) (e.g., in some cases 540 kg or more), some embodiments of the described wall weigh less than 100 kg (e.g., less than about 40 kg).

As another example of a feature, some embodiments of the climbing wall 10 allow for the climbing surface 15 to be moved to many (if not an infinite number) of positions (or angles). In still another example, some embodiments of the described climbing wall are configured to automatically change in position, provide training, record movements, provide communication channels with one or more parties in one or more remote locations, and/or otherwise provide dynamic interaction as the wall is used.

Representative Operating Environment

The described climbing wall 10 can be used with or in any suitable operating environment and/or software. In this regard, FIG. 22 and the corresponding discussion are intended to provide a general description of a suitable operating environment (e.g., computer system 55) in accordance with some embodiments of the described systems and methods. As will be further discussed below, some embodiments embrace the use of one or more processing (including, without limitation, micro-processing) units in a variety of customizable enterprise configurations, including in a networked configuration, which may also include any suitable cloud-based service, such as a platform as a service or software as a service.

Some embodiments of the described systems and methods embrace one or more computer readable media, wherein each medium may be configured to include or includes thereon data or computer executable instructions for manipulating data. The computer executable instructions include data structures, objects, programs, routines, or other program modules that may be accessed by one or more processors, such as one associated with a general-purpose processing unit capable of performing various different functions or one associated with a special-purpose processing unit capable of performing a limited number of functions. In this regard, in some embodiments, the processing unit 75 (described above) comprises a specialized processing unit that is configured for use with the described system 10.

Computer executable instructions cause the one or more processors of the enterprise to perform a particular function or group of functions and are examples of program code means for implementing steps for methods of processing. Furthermore, a particular sequence of the executable instructions provides an example of corresponding acts that may be used to implement such steps.

Examples of computer readable media (including non-transitory computer readable media) include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), or any other device or component that is capable of providing data or executable instructions that may be accessed by a processing unit.

Figure 22:
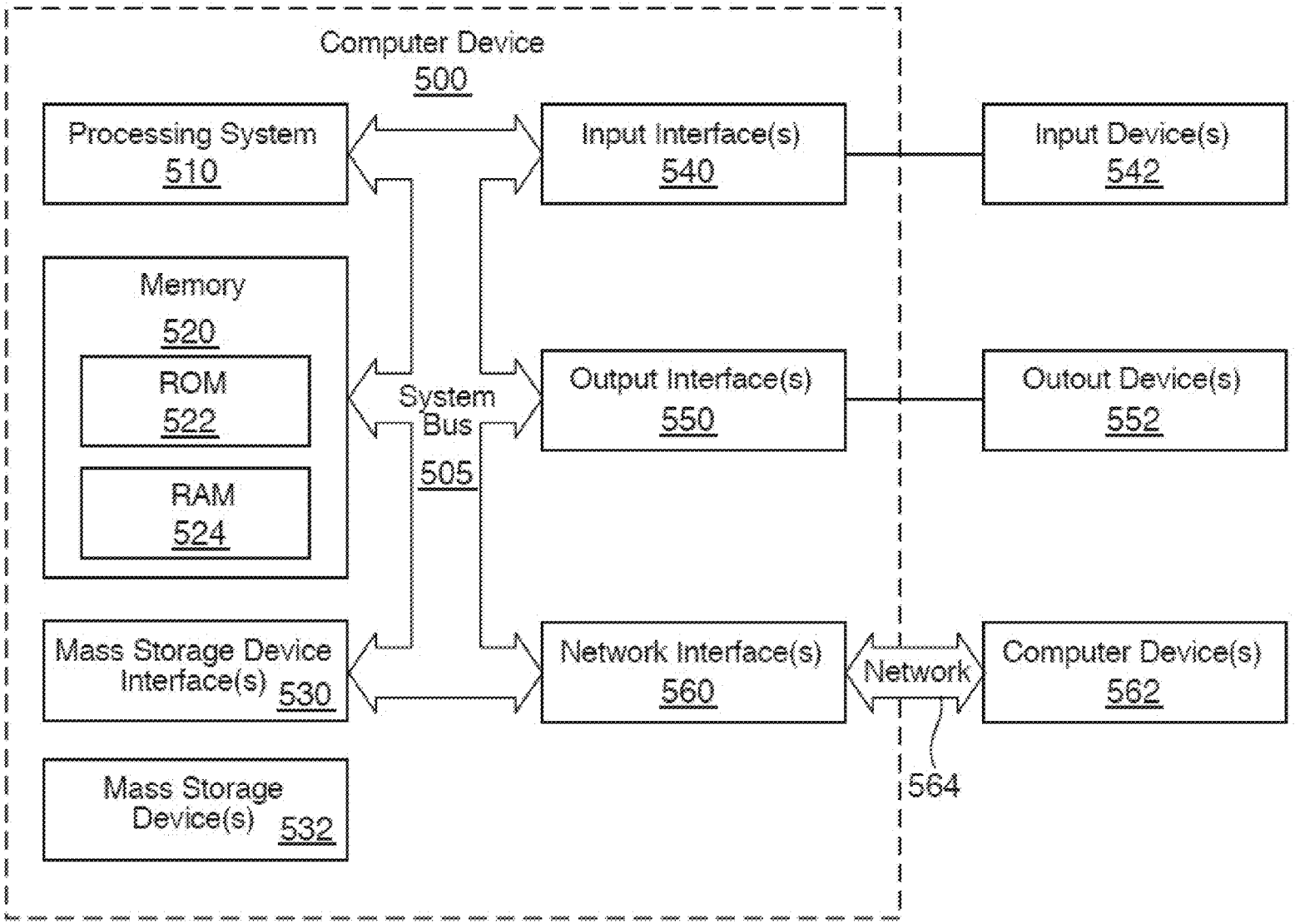
FIG. 22 illustrates a representative system that provides a suitable operating environment for use with some embodiments of the adjustable climbing wall.

With reference to FIG. 22, a representative system includes computer device 400 (e.g., a computer processor and/or other control unit), which may be a general-purpose or special-purpose computer (e.g., processing unit 75). For example, computer device 400 may be a personal computer, a notebook computer, a PDA or other hand-held device, a workstation, a minicomputer, a mainframe, a supercomputer, a multi-processor system, a network computer, a processor-based consumer device, a cellular phone, a tablet computer, a smart phone, a feature phone, a smart appliance or device, a control system, and/or the like.

Computer device 400 includes system bus 405, which may be configured to connect various components thereof and enables data to be exchanged between two or more components. System bus 405 may include one of a variety of bus structures including a memory bus or memory controller, a peripheral bus, or a local bus that uses any of a variety of bus architectures. Typical components connected by system bus 405 include processing system 410 and memory 420. Other components may include one or more mass storage device interfaces 430, input interfaces 440, output interfaces 450, and/or network interfaces 460, each of which will be discussed below.

Processing system 410 includes one or more processors, such as a central processor and optionally one or more other processors designed to perform a particular function or task. It is typically processing system 410 that executes the instructions provided on computer readable media, such as on the memory 420, a magnetic hard disk, a removable magnetic disk, a magnetic cassette, an optical disk, or from a communication connection, which may also be viewed as a computer readable medium.

Memory 420 includes one or more computer readable media (including, without limitation, non-transitory computer readable media) that may be configured to include or includes thereon data or instructions for manipulating data, and may be accessed by processing system 410 through system bus 405. Memory 420 may include, for example, ROM 422, used to permanently store information, and/or RAM 424, used to temporarily store information. ROM 422 may include a basic input/output system ("BIOS") having one or more routines that are used to establish communication, such as during start-up of computer device 400. RAM 424 may include one or more program modules, such as one or more operating systems, application programs, and/or program data.

One or more mass storage device interfaces 430 may be used to connect one or more mass storage devices 432 to the system bus 405. The mass storage devices 432 may be incorporated into or may be peripheral to the computer device 400 and allow the computer device 400 to retain large amounts of data. Optionally, one or more of the mass storage devices 432 may be removable from computer device 400. Examples of mass storage devices include hard disk drives, magnetic disk drives, tape drives, solid state mass storage, and optical disk drives.

Examples of solid state mass storage include flash cards and memory sticks. A mass storage device 432 may read from and/or write to a magnetic hard disk, a removable magnetic disk, a magnetic cassette, an optical disk, or another computer readable medium. Mass storage devices 432 and their corresponding computer readable media provide nonvolatile storage of data and/or executable instructions that may include one or more program modules, such as an operating system, one or more application programs, other program modules, or program data. Such executable instructions are examples of program code means for implementing steps for methods disclosed herein.

One or more input interfaces 440 may be employed to enable a user to enter data (e.g., initial information) and/or instructions to computer device 400 through one or more corresponding input devices 442. Examples of such input devices include a keyboard and/or alternate input devices, such as a digital camera, a sensor, bar code scanner, debit/credit card reader, signature and/or writing capture device, pin pad, touch screen, mouse, trackball, light pen, stylus, or other pointing device, a microphone, a joystick, a game pad, a scanner, a camcorder, and/or other input devices. Similarly, examples of input interfaces 440 that may be used to connect the input devices 442 to the system bus 405 include a serial port, a parallel port, a game port, a universal serial bus ("USB"), a firewire (IEEE 1394), a wireless receiver, a video adapter, an audio adapter, a parallel port, a wireless transmitter, or another interface.

One or more output interfaces 450 may be employed to connect one or more corresponding output devices 452 to system bus 405. Examples of output devices include a monitor or display screen, a speaker, a wireless transmitter, a printer, and the like. A particular output device 452 may be integrated with or peripheral to computer device 400. Examples of output interfaces include a video adapter, an audio adapter, a parallel port, and the like.

One or more network interfaces 460 enable computer device 400 to exchange information with one or more local or remote computer devices, illustrated as computer devices 462, via a network 464 that may include one or more hardwired and/or wireless links. Examples of the network interfaces include a network adapter for connection to a local area network ("LAN") or a modem, BLUETOOTH™, WiFi, a cellular connection, a wireless link, or another adapter for connection to a wide area network ("WAN"), such as the Internet. The network interface 460 may be incorporated with or be peripheral to computer device 400.

Figure 23:
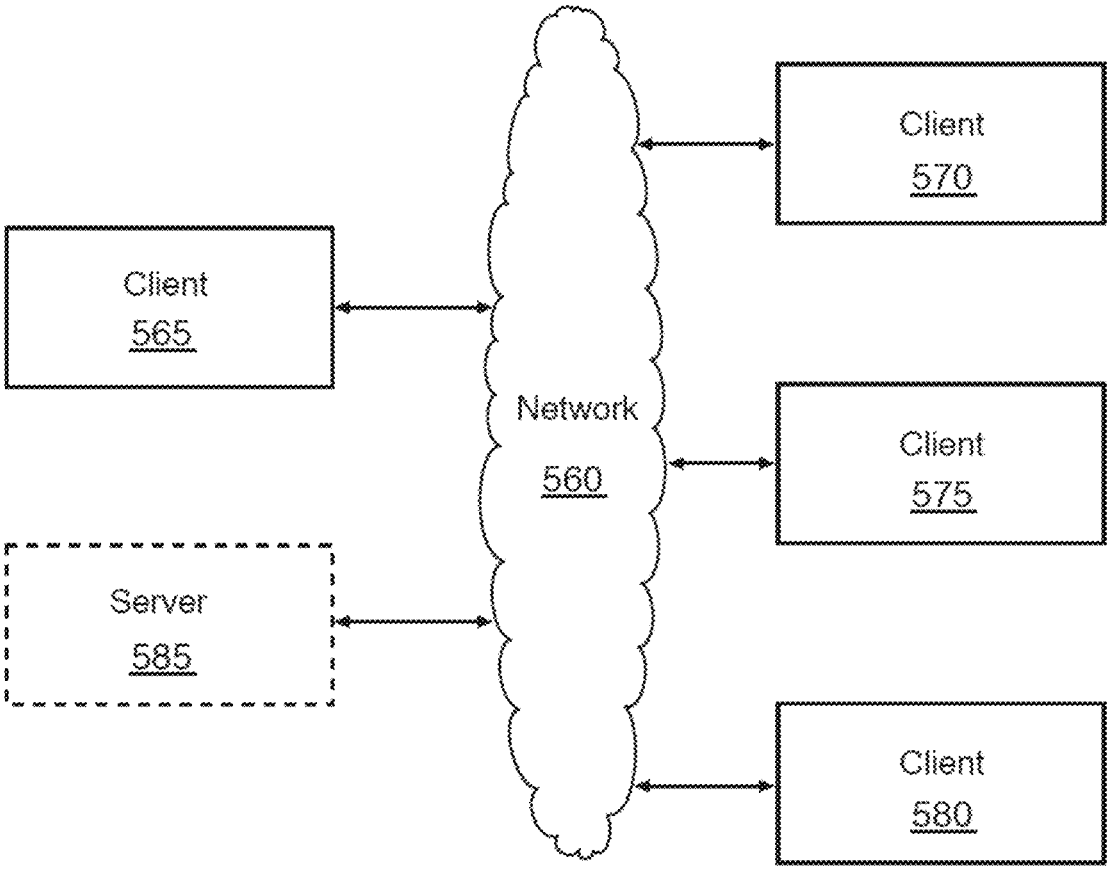
FIG. 23 illustrates a representative embodiment of a networked system that provides a suitable operating environment for use with some embodiments of the adjustable climbing wall.

In a networked system, accessible program modules or portions thereof may be stored in a remote memory storage device. Furthermore, in a networked system computer device 400 may participate in a distributed computing environment, where functions or tasks are performed by a plurality networked computer devices. While those skilled in the art will appreciate that the described systems and methods may be practiced in networked computing environments with many types of computer system configurations, FIG. 23 represents an embodiment of a portion of the described systems in a networked environment that includes clients (465, 470, 475, etc.) connected to a server 485 via a network 460. While FIG. 23 illustrates an embodiment that includes 3 clients (e.g., climbing walls 10, etc.) connected to the network, alternative embodiments include at least one client connected to a network or many clients connected to a network. Moreover, embodiments in accordance with the described systems and methods also include a multitude of clients throughout the world connected to a network, where the network is a wide area network, such as the Internet. Accordingly, in some embodiments, the described systems and methods can allow for remote: monitoring, training, communication between climbing walls (and/or other suitable devices), variation of the climbing wall (e.g., by having a program, a trainer, a friend, and/or other entity in another location vary a position of the climbing surface 15 and/or otherwise varying the climbing wall 10), observation, control, adjustment, trouble shooting, data collecting, system optimization, user interaction, and/or other controlling of the wall 10 from one or more places throughout the world.

Thus, as discussed herein, embodiments of the present invention embrace systems and methods for climbing. More particularly, some implementations of the described invention relate to systems and methods for providing an adjustable climbing wall having a climbing surface that is readily adjustable to a plurality of positions.

The present invention may be embodied in other specific forms without departing from its spirit or essential characteristics. The described embodiments, examples, and illustrations are to be considered in all respects only as illustrative and not restrictive. The scope of the invention is, therefore, indicated by the appended claims rather than by the foregoing description. All changes that come within the meaning and range of equivalency of the claims are to be embraced within their scope. In addition, as the terms on, disposed on, attached to, connected to, coupled to, etc. are used herein, one object (e.g., a material, element, structure, member, etc.) can be on, disposed on, attached to, connected to, or coupled to another object—regardless of whether the one object is directly on, attached, connected, or coupled to the other object, or whether there are one or more intervening objects between the one object and the other object. Also, directions (e.g., front back, on top of, below, above, top, bottom, side, up, down, under, over, upper, lower, lateral, etc.), if provided, are relative and provided solely by way of example and for ease of illustration and discussion and not by way of limitation. Where reference is made to a list of elements (e.g., elements a, b, c), such reference is intended to include any one of the listed elements by itself, any combination of less than all of the listed elements, and/or a combination of all of the listed elements. Furthermore, as used herein, the terms a, an, and one may each be interchangeable with the terms at least one and one or more.

What is claimed is:

1. A climbing wall system comprising:

a climbing surface having a frontside, a backside, a top end, and a bottom end, wherein the frontside is configured to have multiple climbing holds disposed thereon;

a first horizontal support that is configured to contact a floor;

a second horizontal support that is configured to contact the floor;

a transverse member that extends between and couples the first horizontal support and the second horizontal support;

a pivoting mechanism that pivotally couples the climbing surface to the first and second horizontal supports;

a frame that is configured to support a portion of a weight of the climbing surface such that the climbing wall system is configured to be self-standing when only supported by the floor, the frame comprising:

a first frame member that extends upwardly from the first horizontal support, back behind a pivot axis of the pivoting mechanism; and a second frame member that extends upwardly from the second horizontal support, back behind the pivot axis of the pivoting mechanism; and an adjustable support that extends between the climbing surface and the frame, the adjustable support being selectively adjustable to vary an angle of the climbing surface with respect to the floor, wherein a first portion of the first horizontal support and a first portion of the second horizontal support each extend out past, and in front of, the pivot axis of the pivoting mechanism, with the pivot axis of the pivoting mechanism being disposed at the bottom end of the climbing surface and above the transverse member.

2. The climbing wall system of claim 1, wherein the transverse member supports a base member.

3. The climbing wall system of claim 1, further comprising an adjustment mechanism that is coupled to the adjustable support and that is disposed behind the climbing surface, wherein the adjustment mechanism is configured to be selectively actuated to adjust the angle of the climbing surface with respect to the floor.

4. The climbing wall system of claim 1, wherein the frame comprises a third frame member that extends upwards from the first horizontal support, and wherein an upper end of the third frame member couples to the first frame member such that a longitudinal axis of the first frame member runs at an acute angle with respect to a longitudinal axis of the third frame member.

5. The climbing wall system of claim 1, further comprising a base member that is coupled to the transverse member, wherein the pivot axis of the pivoting mechanism is disposed at a top portion of the base member, wherein the base member is configured to receive a climbing hold, and wherein an orientation of the base member is fixed with respect to the first horizontal support.

6. The climbing wall system of claim 1, wherein the adjustable support comprises at least one of: (i) a cable, (ii) a strap, and (iii) and a rope, and wherein the adjustable support extends from the climbing surface to a portion of the frame that is disposed back behind the pivot axis of the pivoting mechanism.

7. The climbing wall system of claim 1, wherein the first frame member is disposed at a first lateral side of the climbing surface and the second frame member is disposed at a second lateral side of the climbing surface, opposite to the first frame member, wherein the first frame member is coupled to the second frame member via a crosspiece, and wherein the crosspiece is disposed back and behind the pivot axis of the pivoting mechanism.

8. The climbing wall system of claim 1, further comprising the multiple climbing holds on the frontside of the climbing surface, and wherein at least one of the multiple climbing holds comprises an indicator that is configured to indicate a specific hold that is currently being used by another climber on another climbing wall.

9. The climbing wall system of claim 1, wherein an angle between a longitudinal axis of the first horizontal support and a longitudinal axis of the first frame member is at least 90 degrees.

10. The climbing wall system of claim 1, wherein an entire length of a longitudinal axis of the first frame member is disposed behind the pivot axis of the pivoting mechanism.

11. A climbing wall system comprising:

a climbing surface having a frontside, a backside, a top end, and a bottom end, wherein the frontside is configured to have multiple climbing holds disposed thereon;

a first horizontal support that is configured to contact a floor;

a second horizontal support that is configured to contact the floor;

a transverse member that extends between, and that couples together, the first horizontal support and the second horizontal support;

a base member;

a pivoting mechanism that pivotally couples the climbing surface to the base member, with a pivot axis of the pivoting mechanism being disposed at the bottom end of the climbing surface and at a top portion of the base member;

a frame that is configured to support a portion of a weight of the climbing surface such that the climbing wall system is configured to be self-standing when only supported by the floor, the frame comprising:

a first elongated frame member that extends upwardly from a first portion of the first horizontal support that extends past, and back behind, the pivot axis of the pivoting mechanism; and a second elongated frame member that extends upwardly from a first portion of the second horizontal support that extends past, and back behind, the pivot axis of the pivoting mechanism; and an adjustable support that extends between the climbing surface and the frame, with the adjustable support being selected from: (i) a cable, (ii) a strap, and (ii) a rope, and with the adjustable support being selectively adjustable to vary an angle of the climbing surface with respect to the floor, wherein a second portion of the first horizontal support and a second portion of the second horizontal support each extend out past, and in front of, the pivot axis of the pivoting mechanism.

12. The system of claim 11, further comprising a hand crank that is coupled to the adjustable support and that is disposed behind the climbing surface, wherein the hand crank is configured to be selectively actuated to adjust the angle of the climbing surface with respect to the floor.

13. The climbing wall system of claim 11, wherein the transverse member is coupled to the base member.

14. The climbing wall system of claim 11, wherein the adjustable support comprises a cable that couples to the climbing wall and to a portion of the frame that is disposed back behind the pivot axis of the pivoting mechanism.

15. The climbing wall system of claim 11, wherein an angle of the climbing surface automatically varies on the fly, and as part of a preset program.

16. The climbing wall system of claim 11, wherein an entire length of a longitudinal axis of the first elongated frame member is disposed behind the pivot axis of the pivoting mechanism.

17. The climbing wall system of claim 11, further comprising the multiple climbing holds on the frontside of the climbing surface, and wherein at least one of the multiple climbing holds comprises an indicator that is configured to indicate a specific hold that is currently being used by another climber on another climbing wall system.

18. The climbing wall system of claim 11, wherein the first and second horizontal foot supports run substantially parallel with each other and substantially transverse to a width of the climbing surface, wherein the pivot axis of the pivoting mechanism is disposed above the transverse member, and wherein an orientation of the base member is fixed with respect to an orientation of the first horizontal support.

19. A climbing wall system comprising:

a base member;

a climbing surface having a frontside, a backside, a top end, and a bottom end, wherein the frontside is configured to have multiple climbing holds disposed thereon;

a first horizontal support that is configured to contact a floor;

a second horizontal support that is configured to contact the floor;

a transverse member that extends between, and that couples together, the first horizontal support and the second horizontal support; and a pivoting mechanism that pivotally couples the climbing surface to the base member and to the first and second horizontal supports, with a pivot axis of the pivoting mechanism being disposed at the bottom end of the climbing surface and at a top portion of the base member;

a frame that is configured to support a portion of a weight of the climbing surface such that the climbing wall system is configured to be self-standing when only supported by the floor, the frame comprising:

a first elongated frame member that extends upwardly from a first portion of the first horizontal support that extends past, and back behind, the pivot axis of the pivoting mechanism;

a second elongated frame member that extends upwardly from a first portion of the second horizontal support that extends past, and back behind, the pivot axis of the pivoting mechanism;

a third elongated frame member, wherein a first end of the third elongated frame member is coupled to the first horizontal support, and wherein a second end of the third elongated frame member is coupled to the first elongated frame member such that a longitudinal axis of the first elongated frame member runs at an acute angle with respect to a longitudinal axis of the third elongated frame member; and a fourth elongated frame member, wherein a first end of the fourth elongated frame member is coupled to the second horizontal support, and wherein a second end of the fourth elongated frame member is coupled to the second elongated frame member such that a longitudinal axis of the second elongated frame member runs at an acute angle with respect to a longitudinal axis of the fourth elongated frame member; and an adjustable support comprising at least one of (i) a cable, (ii) a strap, and (iii) a rope, with the adjustable support extending between the climbing surface and the frame, with a portion of the adjustable support being coupled to the frame, behind the pivot axis of the pivoting mechanism, and with the adjustable support being selectively adjustable to vary an angle of the climbing surface with respect to the floor, wherein a second portion of the first horizontal support and a second portion of the second horizontal support each extend out past, and in front of the pivot axis of the pivoting mechanism.

20. The climbing wall system of claim 19, wherein the first end of the third elongated frame member is coupled to the first horizontal support such that a portion of the third elongated frame member extends in front of the pivot axis of the pivoting mechanism.

21. The climbing wall system of claim 19, further comprising a hand crank that is coupled to the adjustable support and that is disposed behind the climbing surface, wherein the hand crank is configured to be selectively actuated to adjust the angle of the climbing surface with respect to the floor.

22. The climbing wall system of claim 19, further comprising the multiple climbing holds on the frontside of the climbing surface, and wherein at least one of the multiple climbing holds comprises an indicator that is configured to indicate a specific hold that is currently being used by another climber on another climbing wall system.

23. The climbing wall system of claim 19, wherein the first elongated frame member is disposed at a first lateral side of the climbing surface, wherein the second elongated frame member is disposed at a second lateral side of the climbing surface, opposite to the first lateral side, wherein a crosspiece that is disposed back behind the pivot axis of the pivoting mechanism couples the first elongated frame member to the second elongated member, and wherein the adjustable support is coupled to the crosspiece.

* * * * *